US011583043B2

(12) United States Patent
Tovias et al.

(10) Patent No.: US 11,583,043 B2
(45) Date of Patent: Feb. 21, 2023

(54) PAPER DISPENSER FOR ARTICLE OF JEWELRY

(71) Applicant: Julee J. Tovias, Fountain Valley, CA (US)

(72) Inventors: Julee J. Tovias, Fountain Valley, CA (US); Michael D. Tovias, Fountain Valley, CA (US); Carl TenBrink, Huntington Beach, CA (US)

(73) Assignee: Julee J. Tovias, Fountain Valley, CA (US)

( * ) Notice: Subject to any disclaimer, the term of this patent is extended or adjusted under 35 U.S.C. 154(b) by 30 days.

(21) Appl. No.: 16/752,294

(22) Filed: Jan. 24, 2020

(65) Prior Publication Data

US 2020/0237062 A1 Jul. 30, 2020

Related U.S. Application Data

(60) Provisional application No. 62/796,965, filed on Jan. 25, 2019.

(51) Int. Cl.

| | |
|---|---|
| ***A44C 25/00*** | (2006.01) |
| ***B65H 16/00*** | (2006.01) |
| ***A44C 15/00*** | (2006.01) |

(52) U.S. Cl.

CPC ..... *A44C 25/002* (2013.01); *A44C 15/003* (2013.01); *B65H 16/005* (2013.01)

(58) Field of Classification Search

CPC ..... A44C 25/002; A44C 15/003; A44C 25/00; A44C 25/001; A44C 25/004; B65H 16/005; B65D 83/0805; B65D 83/0847

USPC ..... D11/80; D6/518; 221/33–63

See application file for complete search history.

(56) References Cited

U.S. PATENT DOCUMENTS

| | | | | |
|---|---|---|---|---|
| 475,400 | A * | 5/1892 | Houghton et al. | A44C 25/002 40/660 |
| 486,033 | A * | 11/1892 | Faulkner | A44C 25/004 63/19 |
| 1,107,747 | A * | 8/1914 | Bauer | B65D 83/0805 242/588.3 |
| D135,964 | S * | 7/1943 | De Aragon | D11/44 |
| 2,420,265 | A * | 5/1947 | Schick | A44C 25/002 40/660 |

(Continued)

FOREIGN PATENT DOCUMENTS

| | | | |
|---|---|---|---|
| CN | 102950925 | A | 3/2013 |
| CN | 207396983 | U | 5/2018 |

(Continued)

*Primary Examiner* — Emily M Morgan

(74) *Attorney, Agent, or Firm* — Knobbe, Martens, Olson & Bear, LLP

(57) ABSTRACT

An article of jewelry includes a housing divided into upper and lower portions. The housing can be moveable between an open configuration and a closed configuration. The housing can include therein a post on which a reel assembly including a paper roll can be assembled. One end of the paper roll can be extended through a nonlinear paper slot in an outer wall of the housing. The paper roll can include a plurality of printed messages, stickers, or other designs thereon. The nonlinear paper slot can provide tension to maintain the end of the paper roll within the nonlinear paper slot to facilitate tearing off the end of the paper roll.

11 Claims, 19 Drawing Sheets

(56) References Cited

U.S. PATENT DOCUMENTS 2,586,346 A * 2/1952 King ..... B65D 85/672 225/47
4,185,753 A 1/1980 Leto
D281,369 S * 11/1985 Harris ..... D99/34
4,828,889 A * 5/1989 Sacco ..... A44C 25/00 428/3
4,989,801 A * 2/1991 Thomas ..... B42D 19/00 206/407
5,577,635 A * 11/1996 Block ..... A47K 10/3818 221/45
6,053,357 A * 4/2000 Yoh ..... B65D 83/0805 206/494
6,223,695 B1 * 5/2001 Edwards ..... A01K 27/004 119/796
6,276,859 B1 * 8/2001 Hsu ..... B43K 29/12 15/435
7,040,829 B2 5/2006 Lin
7,246,964 B2 7/2007 Thomas
7,322,766 B2 * 1/2008 Erlebacher ..... B43K 29/12 401/195
7,431,526 B2 10/2008 Lin
7,497,636 B2 3/2009 Fielding, Jr.
7,850,039 B1 * 12/2010 Tsengas ..... E01H 1/1206 221/45
7,950,117 B2 5/2011 Elhaj
7,997,100 B2 8/2011 Fossas
8,002,113 B1 * 8/2011 Cummings ..... B65D 85/672 206/820
D654,739 S * 2/2012 Chin ..... D3/215
D657,174 S * 4/2012 Yatscoff ..... D3/215
8,517,171 B1 * 8/2013 Delgado ..... B65D 21/0231 206/38.1
D695,543 S * 12/2013 Kenmore ..... D6/519
D726,062 S * 4/2015 Silverstein ..... D11/56
8,998,123 B2 * 4/2015 de Jong ..... B65C 11/00 242/615.3
9,604,491 B2 3/2017 Gonzalez, III
9,738,114 B2 8/2017 Shen et al.
9,962,044 B1 * 5/2018 Ovokaitys ..... A47K 10/22
10,687,648 B1 * 6/2020 Lowe ..... A47G 33/08
D923,958 S * 7/2021 Koch ..... D6/518
2002/0084279 A1 7/2002 Lickstein
2003/0182963 A1 * 10/2003 Beatty ..... A44C 15/003 63/1.14
2007/0160413 A1 7/2007 Ybanez
2008/0034792 A1 * 2/2008 McKeever ..... A44C 9/00 63/15.3
2010/0001016 A1 1/2010 Savage
2010/0229596 A1 9/2010 Manning
2011/0127306 A1 6/2011 Haston
2011/0179823 A1 * 7/2011 Moody ..... A44C 9/00 63/4
2012/0118014 A1 5/2012 King et al.
2013/0221146 A1 * 8/2013 Cooper ..... B65H 16/005 242/160.4
2014/0013799 A1 1/2014 Suzanne
2014/0367405 A1 12/2014 Gerasimova
2015/0001332 A1 * 1/2015 Qin ..... B65H 16/005 242/598.3
2015/0165814 A1 6/2015 Ru
2016/0007701 A1 * 1/2016 Silverstein ..... A44C 25/002 63/19
2018/0204486 A1 7/2018 Scorpio-Pappin et al.

FOREIGN PATENT DOCUMENTS

DE 10 2007 032209 A1 1/2009
EP 1264782 A1 * 12/2002 ..... B65D 83/0805
EP 1564025 A1 8/2005
EP 1712372 B1 12/2007
EP 2796067 A1 10/2014
FR 2724751 B3 8/1996
KR 10-2016-0148264 A 12/2016
TW M 295041 U 8/2006
WO WO 2006/043845 A1 4/2006
WO WO-2011021785 A2 * 2/2011 ..... B65D 33/002

* cited by examiner

PAPER DISPENSER FOR ARTICLE OF JEWELRY

CROSS REFERENCE

This application claims the benefit of U.S. Patent Application Ser. No. 62/796,965, filed Jan. 25, 2019, the entirety of which is hereby incorporated by reference.

BACKGROUND

Field

The present disclosure generally relates to articles of jewelry for dispensing paper.

Related Art

Personal ornaments, or jewelry, come in many forms and types, and have been used around the world and throughout recorded history. Jewelry can have many different purposes, depending on the person, culture, and type. These purposes can include enhancing a person's beauty, expressing religious, family or other devotion, signifying personal meanings, and/or conveying certain messages.

SUMMARY

One aspect of this disclosure relates to an article of jewelry for dispensing a paper roll containing printed messages.

Another aspect of this disclosure relates to an article of jewelry having a removable reel assembly for dispensing a paper roll containing printed messages.

Another aspect of this disclosure relates to an article of jewelry having a nonlinear slot for dispensing a paper roll containing printed messages.

The foregoing summary is illustrative only and is not intended to be limiting. Other aspects, features, and advantages of the systems, devices, and methods and/or other subject matter described in this application will become apparent in the teachings set forth below. The summary is provided to introduce a selection of some of the concepts of this disclosure. The summary is not intended to identify key or essential features of any subject matter described herein.

The systems, methods and devices described herein have innovative aspects, no single one of which is indispensable or solely responsible for their desirable attributes. Without limiting the scope of the claims, some of the advantageous features will now be summarized.

BRIEF DESCRIPTION OF THE DRAWINGS

Throughout the drawings, reference numbers are re-used to indicate correspondence between referenced elements. The drawings are provided to illustrate embodiments of the subject matter described herein and not to limit the scope thereof.

DETAILED DESCRIPTION

Figure 1:
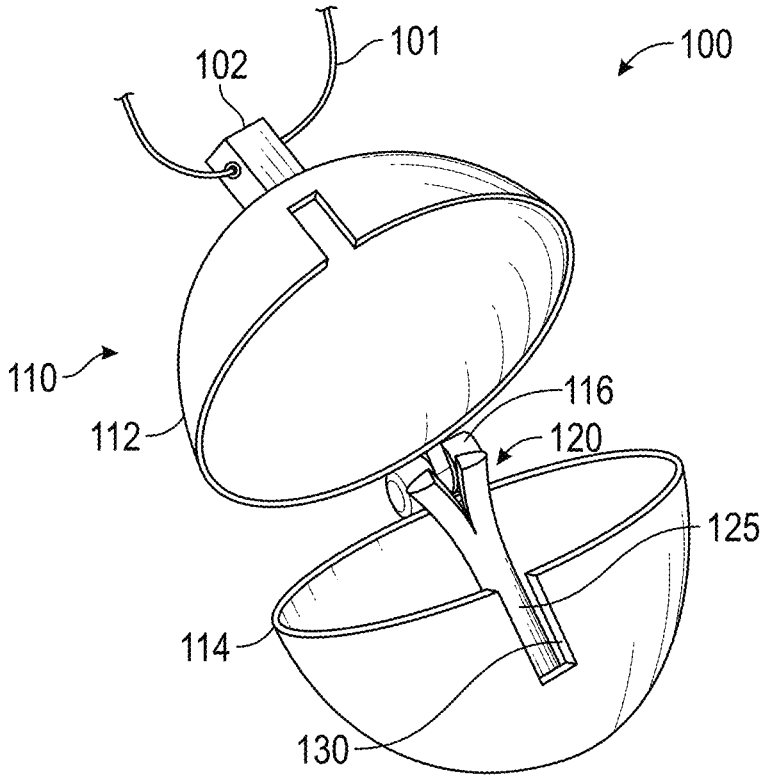
FIG. 1 shows an example pendant in an open configuration in accordance with certain embodiments.

The various features and advantages of the systems, devices, and methods of the technology described herein will become more fully apparent from the following description of the embodiments illustrated in the figures. These embodiments are intended to illustrate the principles of this disclosure, and this disclosure should not be limited to merely the illustrated examples. The features of the illustrated embodiments can be modified, combined, removed, and/or substituted as will be apparent to those of ordinary skill in the art upon consideration of the principles disclosed herein.

The systems described herein, though disclosed in certain contexts, can be used in any type of jewelry with minor adaptations in size and/or geometry. These types of jewelry can include, but are not limited to, necklaces, pendants, broaches, bracelets, wristbands, watches, earrings, headbands, ankle bands, anklets, rings, adornments, accessories, charms and any other jewelry that can be worn on a person's body or clothing, such as on fingers, necks, heads, ears, arms, legs, shirts, pants, coats, or other clothing articles. In some implementations, the jewelry can include accessories for backpacks, purses, baggage, and zipper pulls. In another implementation, the jewelry can include a magnet for attachment with a metallic or ferrous surface including, for example, a refrigerator.

FIGS. 1-5 illustrate a first embodiment of an article of jewelry 100. The article 100 is illustrated as a pendant for a necklace; however, the principles and structures embodied in the article 100 are equally applicable to any other type of jewelry article. The article 100 can be attached with a strand 101 (e.g., necklace). The article 100 can include an attachment point 102. The attachment point 102 can comprise an aperture, clasp, and/or pin or hook for attachment with a person or a person's clothing. The strand 101 can be threaded through or otherwise coupled with the article 100 at an attachment point 102.

The article 100 can include a housing 110 containing an interior volume. The housing 110 can be shaped into to any desirable profile that includes sufficient space for the structures described below. The outer housing can include spherical, conical, rectangular prism, square, irregular, animal shaped, object shaped (e.g., mailbox, purse, globe, backpack, etc.) or any other suitable profile shapes. The material of the housing 110 can be made from any suitable material. The housing 110 can be formed of precious metal, semi-precious metal, any other type of metal, plastic, clear plastic, paper, leather, or any other suitable material for an article of jewelry. In the article 100, the housing 110 is formed of a metallic wire mesh or filigree structure (as shown in the non-limiting example illustrated in FIGS. 2B-C) that is rigid enough to hold the generally spherical shape of the article 100. In several examples, the housing 110 can have a diameter of less than about 1.5, 1.25, 1.0, 0.75, or 0.5 inches. Other diameters and dimensions are possible in accordance with the teachings herein.

The housing 110 can have a first housing portion 112 and a second housing portion 114. The first and second housing portions 112, 114 can split the housing 110 into two halves (equally or otherwise). In one implementation, both the first and second housing portions 112, 114 encompass at least a portion of the interior volume of the housing 110. In another implementation, the first housing portion 112 is essentially a lid for the second housing portion 114, which encompasses the entire interior volume.

The first and second housing portions 112, 114 can be coupled together by a hinge 116. The hinge 116 can include a pin and the first and second housing portions 112, 114 can have one or more extensions or flanges extending therefrom. The pin of the hinge 116 can extend through apertures of the flanges to pivotably couple together the first and second housing portions 112, 114. Other hinge structures can alternatively be employed. The hinge 116 allows the first and second housing portions 112, 114 to open and provide access into the interior volume of the housing 110. In one implementation, the first housing portion 112 can be rotated about the hinge 116 at least 180° relative to the second housing portion 114 to fully open the housing 110. In one implementation, the hinge 116 includes a spring that can bias the housing portions 112, 114 into a closed configuration.

The housing 110 can include a clasp (not shown). The clasp can couple the first and second housing portions 112, 114 together such that the interior volume remains substantially enclosed. The clasp can be manipulated by a user to allow for opening and closing of the housing 110. In another implementation, the first and second housing portions 112, 114 can each include a loop opposite the hinge 116. The loops can be aligned in the closed configuration of the housing 110. In the closed configuration, the strand 101 can be passed through both loops to secure together the housing portions 112, 114 in the closed configuration. The housing 110 can be opened by removing the strand 101 from the loops.

Figure 2A:
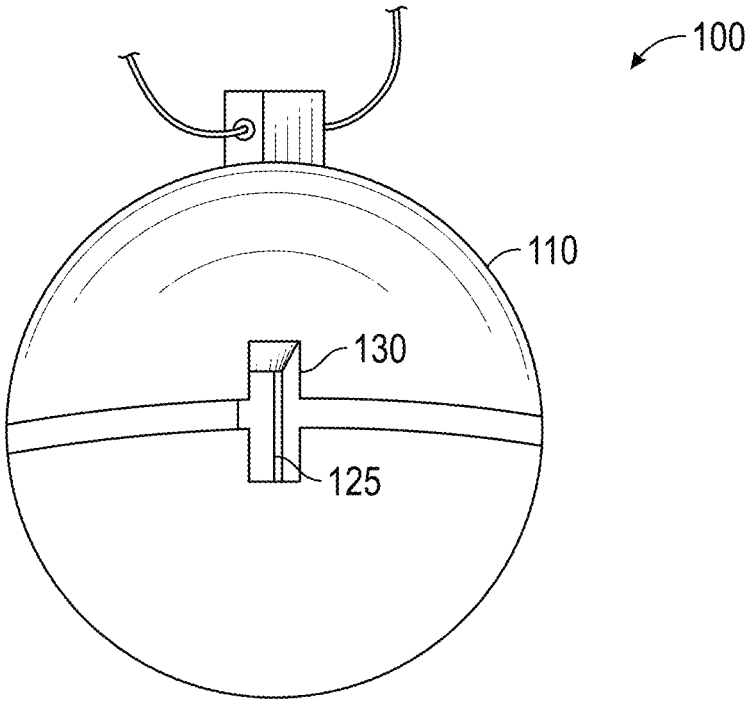
FIG. 2A shows the example pendant of FIG. 1 in a closed configuration in accordance with certain embodiments.
Figure 2B:
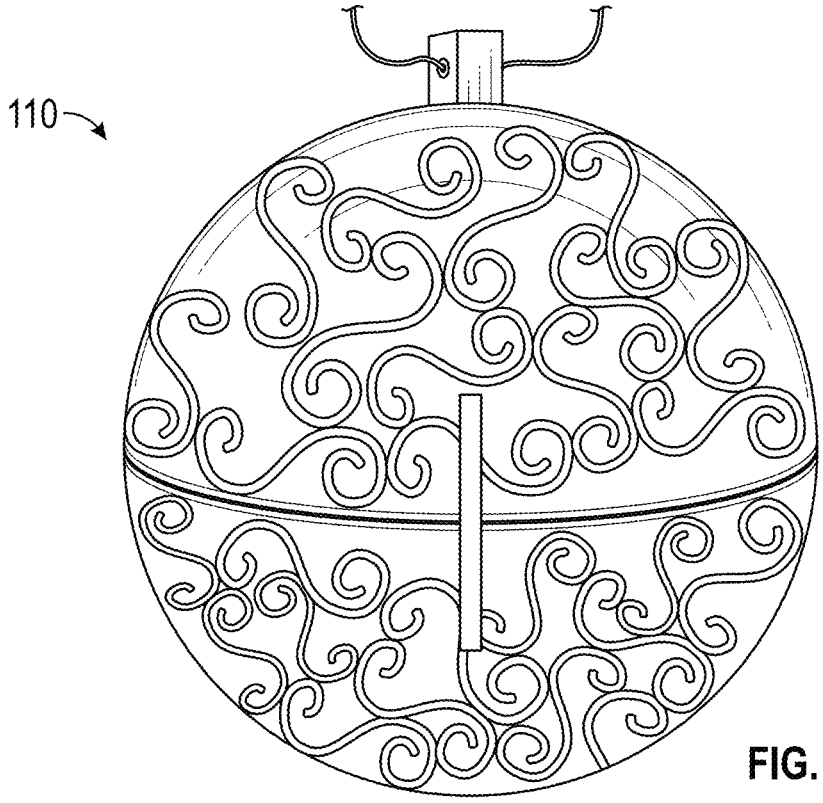
FIGS. 2B-C show exemplary embodiments of a housing of the pendant.
Figure 2C:
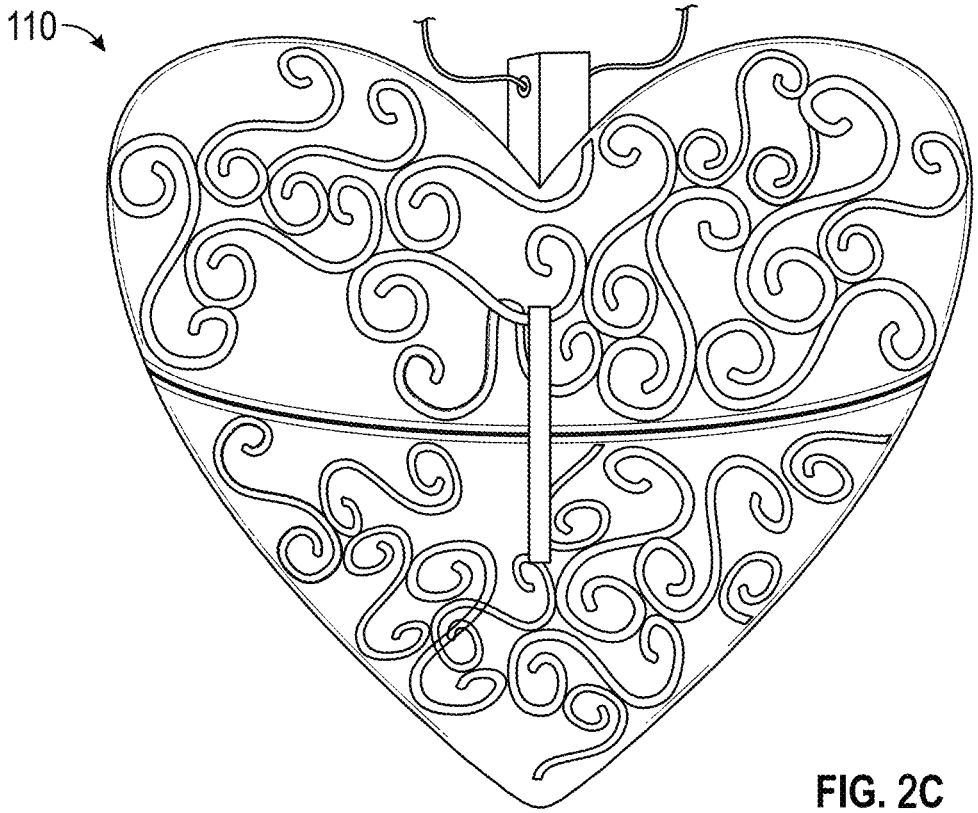

FIG. 1 illustrates the housing 110 in an open configuration providing access to the interior volume thereof. In this configuration, the first housing portion 112 is rotated with respect to the second housing portion 114 about the hinge 116. FIG. 2A shows the housing 110 in a closed configuration. The clasp (if any) can be engaged to hold together the first and second housing portions 112, 114 to prevent access to the interior space and/or to secure one or more items contained therein.

The housing 110 can include an aperture or slot 130. The slot 130 can extend through the housing 110. The slot 130 can extend through the housing 110 to provide access into or out of the interior volume when the housing 110 is in the closed configuration. The slot 130 can extend through the first and/or second housing portions 112, 114. The slot 130 can be tapered from a wider width on the interior side of the housing 110 to a narrow width. The slot 130 can have a narrow width of less than about 0.006, 0.008, or 0.010 inches to allow a single sheet of paper therethrough. Alternatively, the slot width can be between 0.005 and 0.25 inches. The slot 130 can be linear. Alternatively, as described below, the slot 130 can be nonlinear.

The housing 110 can include a mounting assembly 120. The mounting assembly 120 can include a mounting post 125. The mounting post 125 can have an inner end 121 that is attached with the housing 110. The inner end 121 can be attached directly or indirectly with the first or second housing portions 112, 114 on an interior side thereof. The attachment between the housing 110 and the inner end 121 can be mechanical (e.g., adhered, welded, clamps, threaded, or otherwise).

The mounting post 125 can extend outwardly from the housing 110 into the interior volume to an outer end. The mounting post 125 can be generally tubular between the inner and outer ends. In one implementation, the mounting post 125 is cylindrical in shape between the inner and outer ends. The mounting post 125 can be made of the same material as the housing 110 or a different material. In at least some implementations, the outer end can include an elastic material.

The mounting post 125 can include a retaining mechanism 122. The retaining mechanism 122 can have various shapes and structures, as described further below in relation to FIGS. 8-18. The retaining mechanism 122 can include a forked portion of the outer end of the post 125. First and second forks 122*a*, 122*b* can be biased outwardly from a longitudinal centerline of the mounting post 125. The first and second forks 122*a*, 122*b* can be elastically bent inwardly. The first and second forks 122*a*, 122*b* can be formed of a resilient and/or elastic material.

Figure 3:
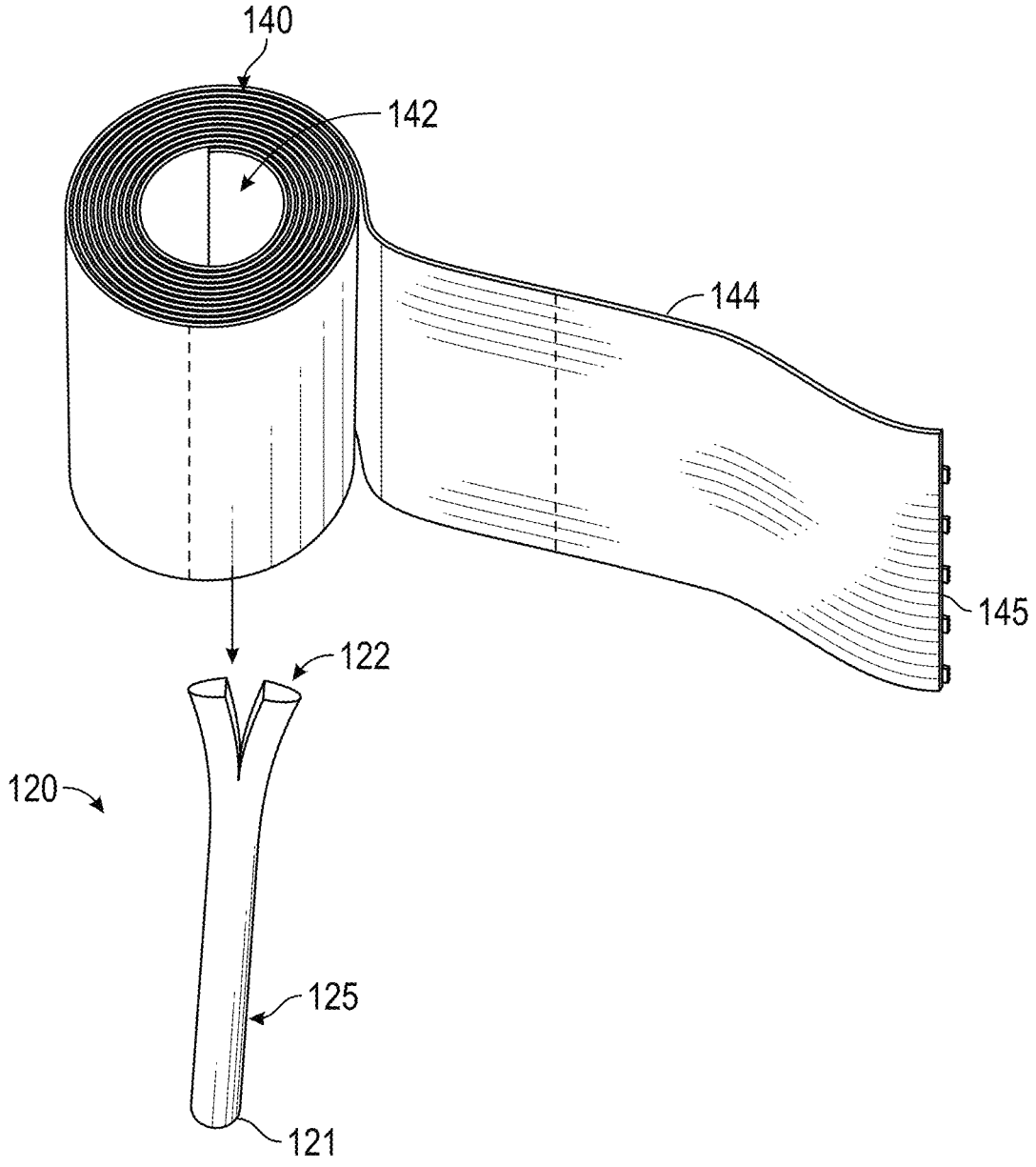
FIG. 3 shows an example reel assembly for seating on a mounting post of the pendant of FIG. 1 in accordance with certain embodiments.
Figure 4:
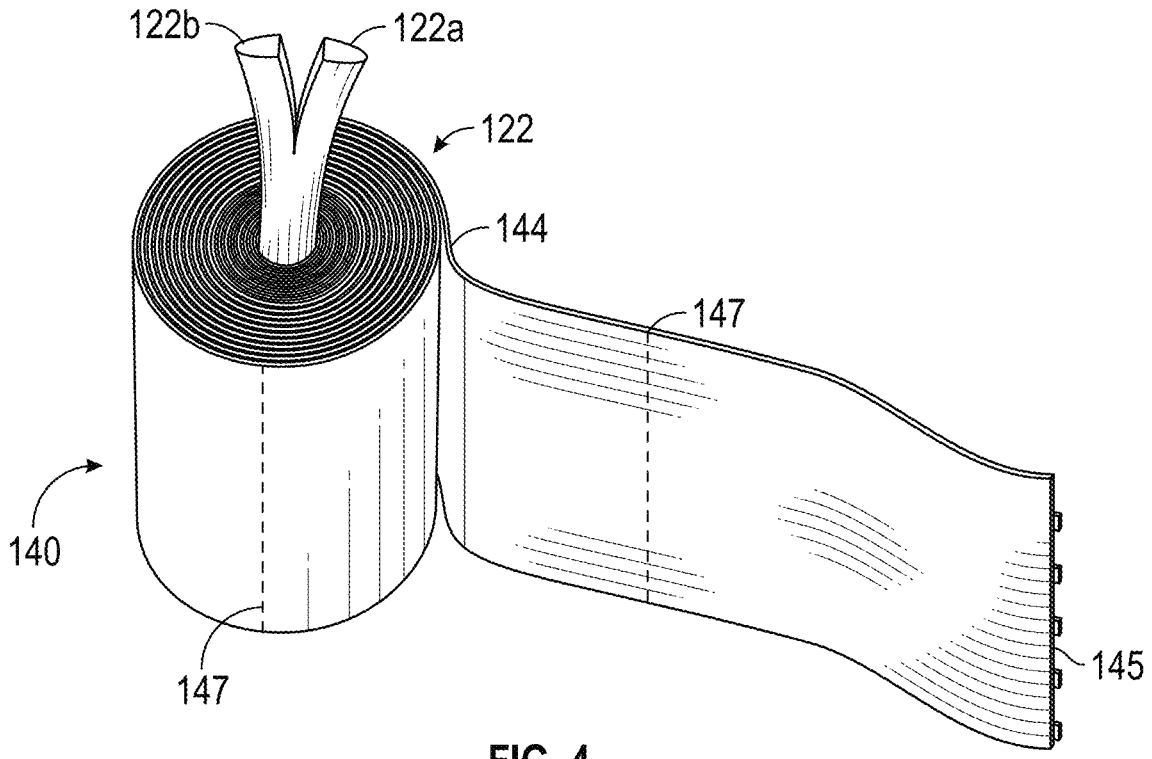
FIG. 4 shows the example reel assembly seated on the mounting post in accordance with certain embodiments.
Figure 5A:
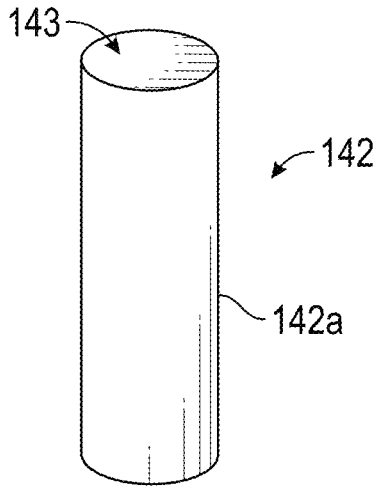
FIG. 5A shows an exemplary embodiment of a reel.

FIGS. 3-5 illustrate a reel assembly 140. The reel assembly 140 can comprise a reel 142 and a roll 144 wrapped around the reel 142. The roll 144 can include a strip of paper that has a lateral width and a length. The length of the strip can be wrapped around the reel 142. An outer tail section 145 of the roll 144 can be free so as to be accessible for unrolling the strip from the reel 142. The strip of paper can include one or more perforation lines 147. The perforations lines 147 can extend laterally across the lateral width of the strip of paper at intervals along the length of the strip of paper. For example, the perforation lines can be spaced apart at about less than 1, 2, 3, 4, 5, 6, 7, 8, 9, 10 inches or greater. The first perforation line 147 at the outer tail section 145 can be spaced closer the end of the strip of paper than the next perforation line 147. In one implementation, the first perforation line is 0.5 inches from the end of the strip of paper. The strip can have a lateral width that is equal to, for example, about 1.0, 0.875, 0.75, 0.625, 0.5, 0.375, 0.250, or 0.125 inches. The strip can have a length that is about 200, 100, 99.5, 48, 36, 24, or 12 inches or less. The material of the strip of paper can be a paper pulp, plastic, textile, or any suitable material for assembly with the reel 142. Accordingly, in certain embodiments, the paper of the roll 144 may be made of a material other than paper, or may be made of a material combined with paper. For example, the roll 144 may include any material that can be written upon by a user or a machine. In some cases, the paper or alternative material of the roll 144 may be written upon or otherwise marked using ink or a non-ink alternative. For example, the paper may be burned or etched using, for example, a laser or other marking tool. In one implementation, the strip of paper includes an adhesive on one side thereof and a nonstick backing surface attached thereto (e.g., a sticker) and/or linerless adhesive reels.

Figure 5B:
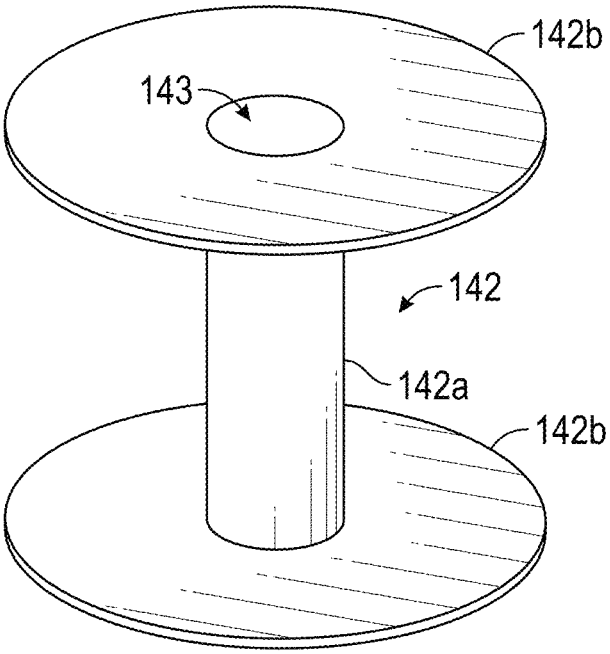
FIG. 5B shows another exemplary embodiment of the reel.
Figure 5C:
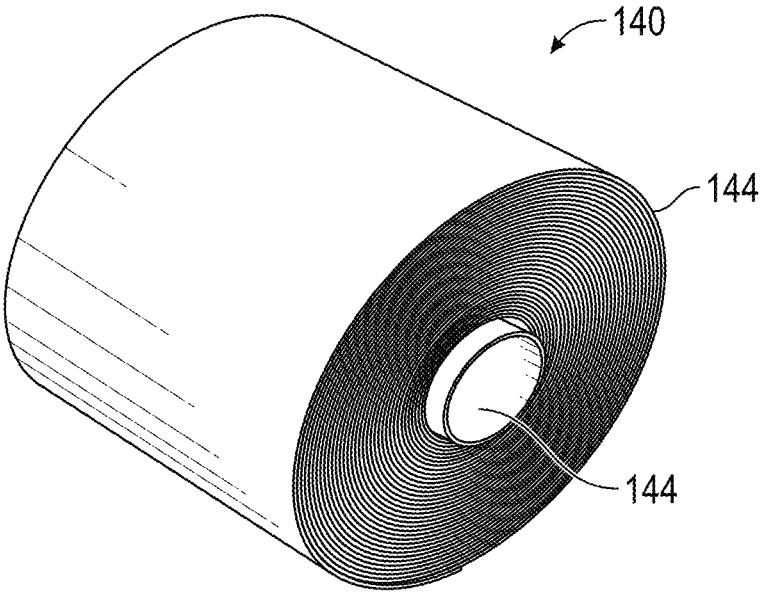
FIG. 5C shows another exemplary embodiment of the reel.

The reel 142 can include a reel body 142*a*. The strip of paper can be wrapped about the reel body 142*a*. The reel body 142*a* can be generally tubular and/or generally cylindrical in cross sectional shape. An aperture 143 can extend partially or fully through with the reel body 142*a*. Optionally, as shown in FIG. 5B, the reel 142 can include one or more outer flanges 142*b*. The outer flanges 142*b* can be generally disc-shaped extensions on one or both ends of the reel body 142*a*. The outer flanges 142*b* can maintain the strip of paper on the reel 142. The outer flanges 142*b* can have diameters sized to generally match the maximum diameter of the roll 144. FIG. 5C illustrates another embodiment of the reel assembly 140 having a reel 142 and a roll 144.

The reel assembly 140 can be coupled with the mounting assembly 120. When so assembled, the reel assembly 140 can be rotatable with respect to the housing 110. To assemble the reel assembly 140 with the mounting assembly 120, the central aperture 143 of the reel 142 can be received on the mounting post 125. The first and second forks 122*a*, 122*b* of the retaining mechanism 122 can be adjusted (e.g., bent generally inwardly or together) to fit into the central aperture 143 of the reel 142. Once the reel assembly 140 is over the outer end of the mounting post 125, the reel 142 can be seated by sliding over the mounting post 125 to a seated position (e.g., against the housing 110 at the inner end 121). In the seated position of the reel assembly 140, the retaining mechanism 122 can be fully within, partially within, or extended out of the aperture 143, depending on the length of the mounting post 125.

The outwardly biased forks 122*a*, 122*b* can frictionally engage with the interior surface of the aperture 143. Optionally, other surfaces of the mounting post 125 (e.g., the body) can frictionally engage the reel 142. The friction forces exerted by the forks 122*a*, 122*b* or other surfaces can resist rotation of the reel 142 about the mounting post 125 and/or prevent or hinder removal of the reel assembly 140 from the mounting post 125. In some implementations, the reel assembly 140 is snap-fitted into the seated position on the mounting post 125.

The outer tail section 145 of the strip of paper can be fed through the slot 130. The wider width of the interior slot 130 that tapers to the narrow width of the slot 130 can facilitate feeding of the outer tail section 145 from the interior side to the exterior of the housing 110 by a user. The housing portions 112, 114 can be closed together to enclose the reel assembly 140.

Figure 6:
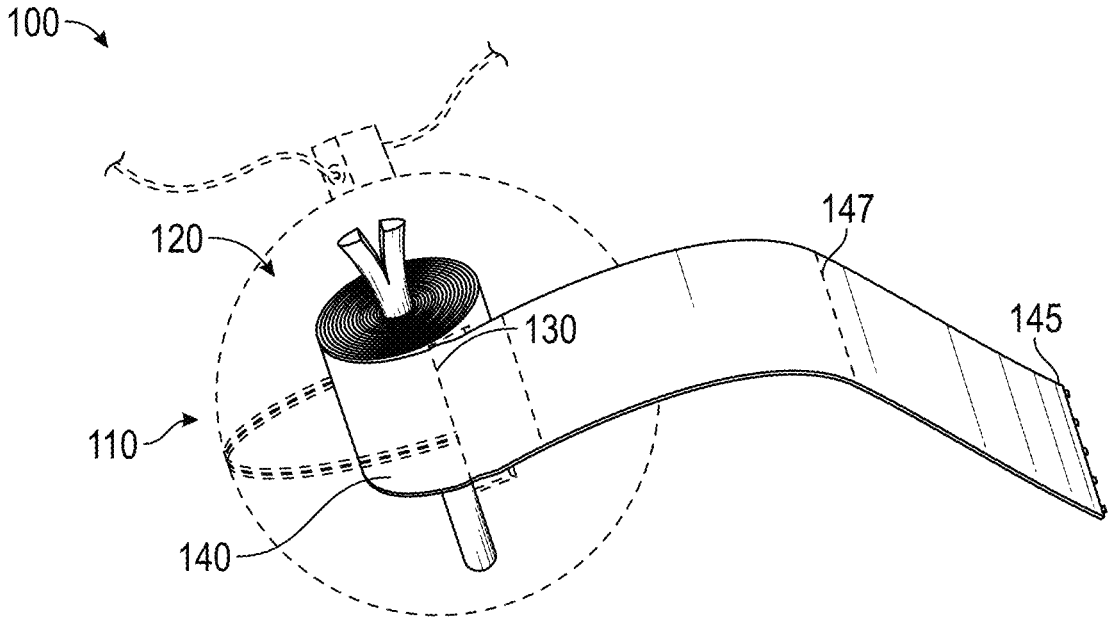
FIG. 6 shows the example pendant of FIG. 1 in a fully assembled configuration in accordance with certain embodiments.

FIG. 6 shows the fully assembled article 100 with the reel assembly 140 assembled with the retaining mechanism 122 and the outer tail section 145 within the slot 130. Once assembled, the outer tail section 145 can be retrieved by a user through the slot 130 without requiring the housing 110 be opened. The perforation lines 147 can facilitate tearing off portions of the outer tail section 145 defined by the perforation lines 147. Friction created by the interface of the mounting post 125 and the reel 142 can act as a drag mechanism that prevents unwanted unrolling of the roll 144 through the slot 130 (e.g., free rolling of the roll 144 within the housing 110 without commensurate withdrawal of the tail section 145). Ideally, the user can tear off the outer tail section 145 with a single hand (e.g., without need to grasp the tail section 145 to perform the tear). Alternatively, two hands may be required.

In one implementation, the slot 130 further includes a serrated or smooth cutting blade to cut the outer tail section 145. The blade can be in lieu of or in addition to the perforations. The cutting implement can be attached along an inner or outer edge of the slot 130 or within the slot 130. The cutting surfaces of the cutting blade are faced inwardly or at least not outwardly such that they are not a hazard to the user in wearing the article 100.

The roll 144 can include printed messages, pictures, stickers, or other decoration thereon. In one implementation, the entire length of the roll 144 can include an adhesive backing or linerless adhesive. Each interval (e.g., between sets of perforation lines 147) can include a single message. The messages contained on the roll 144 can be themed and can correspond to an overall theme that is selected by a user. The reel assembly 140 can be replaceable so that a user can choose between many different themes according to each user's preferences. Periodically, the user can change messages carried in the article 100 by replacing the reel assembly 140, reel 142, and/or the roll 144. Advantageously, the article 100 allows the user to keep the same jewelry housing 110 and change the messages contained therein by changing/replacing the reel assembly 140.

The reel assembly 140 can be replaced by removal of the reel 142 from the retaining mechanism 122. The reel 142 can be manually detached from the mounting pin 125. The retaining mechanism 122 can be adjusted (e.g., the forked portions 122*a*, 122*b* can be squeezed together) to allow the reel 142 to be retrieved. Another reel assembly 140 can then be assembled with the retaining mechanism 122 in the same manner as described above.

Figure 7A:
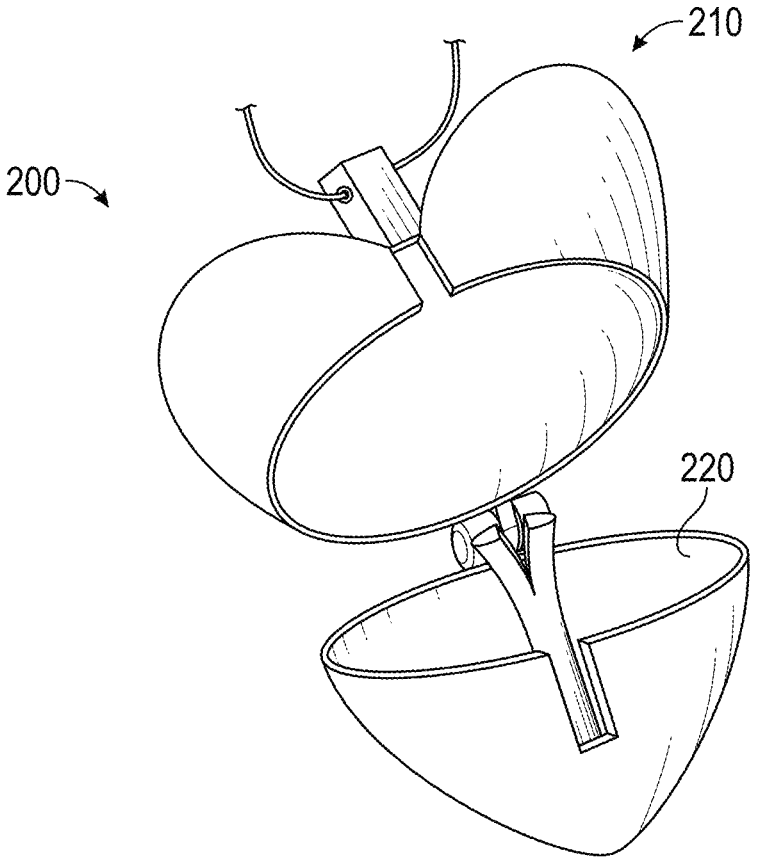
FIGS. 7A-7C show a second exemplary embodiment of a pendant.
Figure 7B:
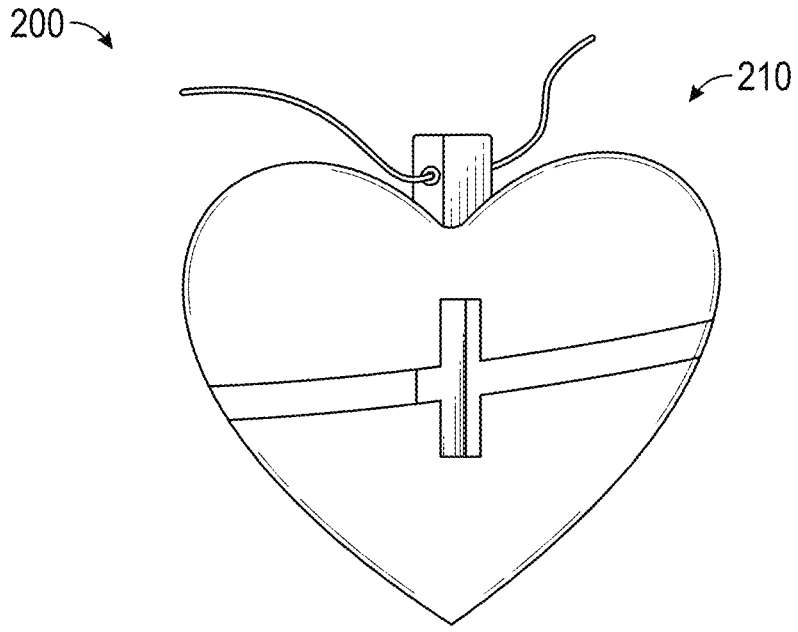
Figure 7C:
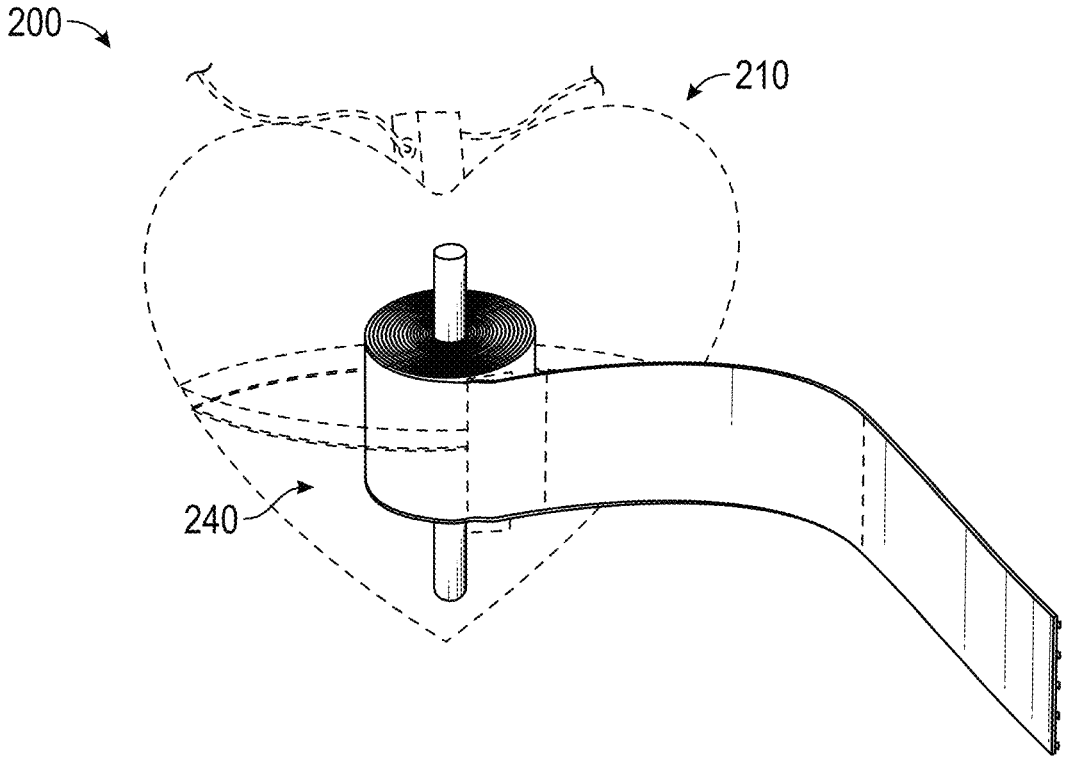

FIGS. 7A-7C illustrate another implementation of an article 200. The article 200 can have the same basic components and structures as article 100. A housing 210 can be a different shape than the housing 110. As illustrated, the housing 210 is generally heart shaped but has a similar interior volume for containing a retaining mechanism 220 and a reel assembly 240.

Figure 8A:
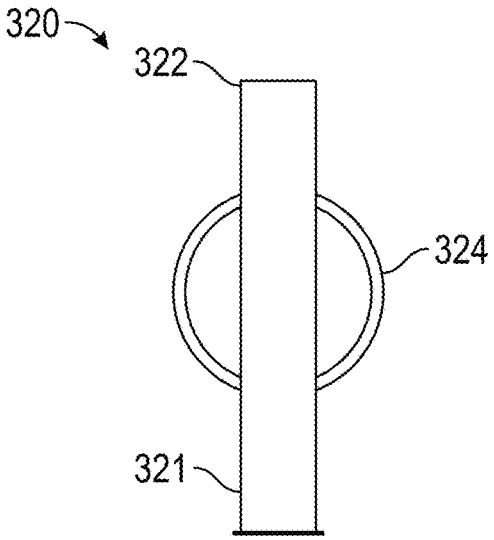
FIGS. 8A-8B show another exemplary embodiment of a mounting post.
Figure 8B:
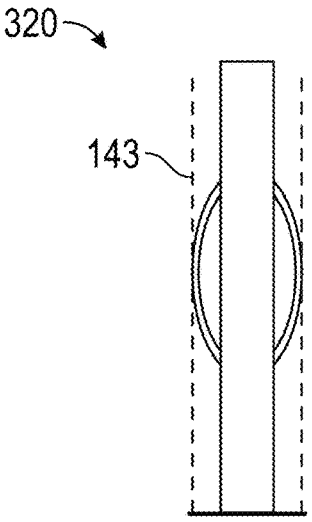

FIGS. 8A-8B illustrate another embodiment of a post 320 that can be used in conjunction with a housing (e.g., housings 110 and 210) and reel assembly (e.g., reel assembly 140). The post 320 can include an inner end 321 and an outer end 322 with a post body therebetween. The first end 321 can be coupled with the housing 110. Aperture 143 of the reel assembly 140 can fit over the outer end 322. The post 320 can include a retaining mechanism in the form of outward projections 324. Outward projections 324 can be spring-like appendages that exert a generally radially outward force from the post body. This force can engage with the interior surface of the aperture 143 of that reel assembly 140, as shown in dash line in FIG. 8B. The outward projections 324 can provide a snap-fit connection and/or a drag mechanism between the reel assembly 140 and the post 320.

Figure 9A:
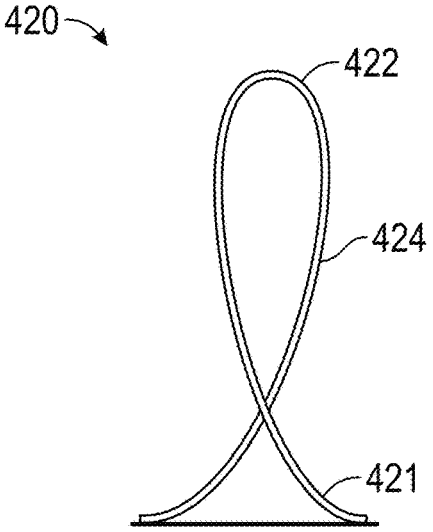
FIGS. 9A-9B show another exemplary embodiment of a mounting post.
Figure 9B:
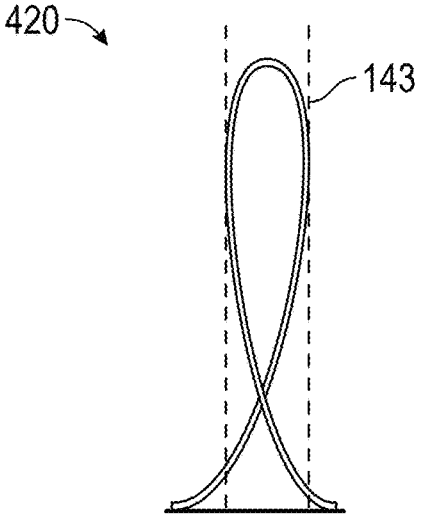

FIGS. 9A and 9B illustrate another embodiment of a post 420 that can be used in conjunction with a housing (e.g., housings 110 and 210) and reel assembly (e.g., reel assembly 140) and including a retaining mechanism. The post 420 can include an inner end 421 and an outer end 422 with a post body therebetween. The first end 421 can be coupled with the housing 110. Aperture 143 of the reel assembly 140 can fit over the outer end 422. The post 420 can be a loop 424 made of wire, plastic or other material that can act as a spring like mechanism for exerting a generally radially outward force. This force can engage with the interior surface of the aperture 143 of that reel assembly 140, as shown in dash line in FIG. 9B. The loop 424 can provide a snap-fit connection and/or a drag mechanism between the reel assembly 140 and the post 420.

Figure 10A:
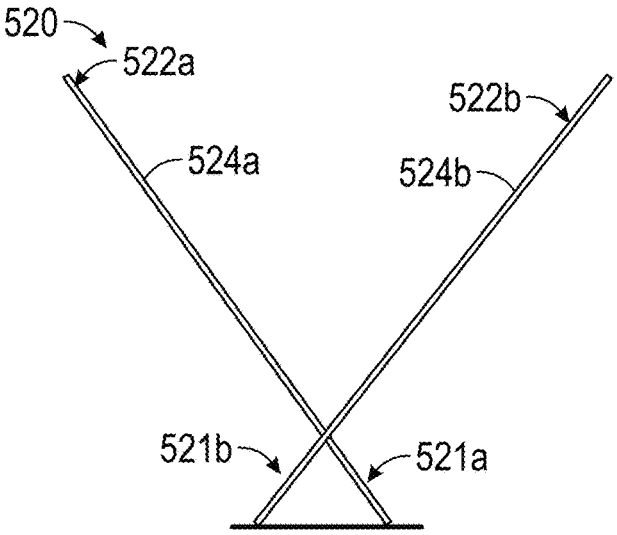
FIGS. 10A-10B show another exemplary embodiment of a mounting post.
Figure 10B:
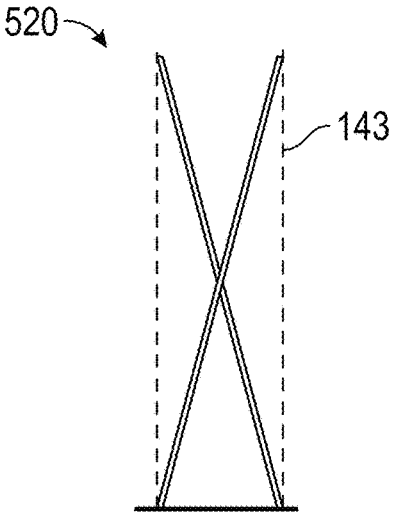

FIGS. 10A-10B illustrate another embodiment of a post 520 that can be used in conjunction with a housing (e.g., housings 110 and 210) and reel assembly (e.g., reel assembly 140) and including a retaining mechanism. The post 520 can include multiple members 524*a*, 524*b* having inner ends 521*a*, 521*b* coupled with the housing 110 and outer ends 522*a*, 522*b*. Aperture 143 of the reel assembly 140 can fit over the outer end 322. The members 524*a*, 524*b* can be biased radially outwardly. The members 524*a*, 524*b* can be spring-like appendages that exert a generally radially outward force when bent. This force can engage with the interior surface of the aperture 143 of that reel assembly 140, as shown in dash line in FIG. 10B. The members 524*a*, 524*b* can provide a snap-fit connection and/or a drag mechanism between the reel assembly 140 and the post 520.

Figure 11A:
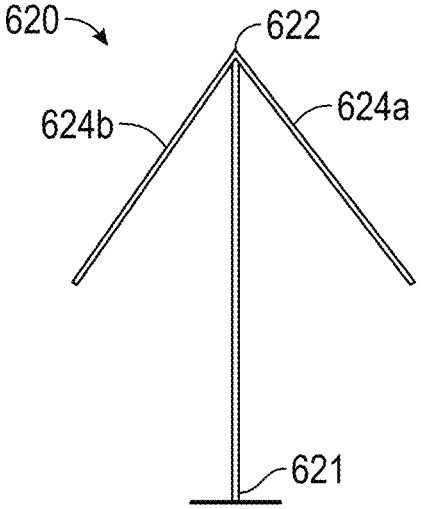
FIGS. 11A-11B show another exemplary embodiment of a mounting post.
Figure 11B:
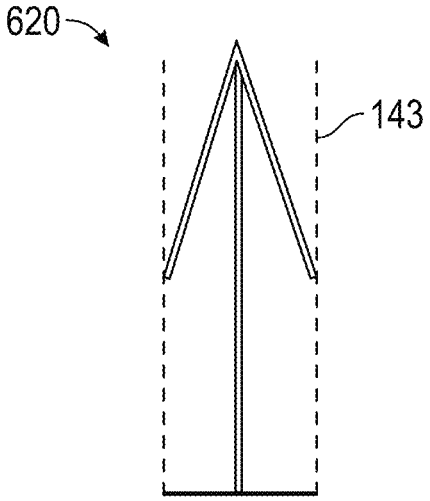

FIGS. 11A-11B illustrate another embodiment of a post 620 that can be used in conjunction with a housing (e.g., housings 110 and 210) and reel assembly (e.g., reel assembly 140) and including a retaining mechanism. The post 620 can include multiple members 624*a*, 624*b*. The post can have an inner end 621 coupled with the housing 110 and an outer end 622. Aperture 143 of the reel assembly 140 can fit over the outer end 622. The members 624*a*, 624*b* can be biased radially outwardly. The members 624*a*, 624*b* can be spring-like appendages that exert a generally radially outward force when bent upwards. This force can engage with the interior surface of the aperture 143 of that reel assembly 140, as shown in dash line in FIG. 11B. The members 624*a*, 624*b* can provide a snap-fit connection and/or a drag mechanism between the reel assembly 140 and the post 620.

Figure 12A:
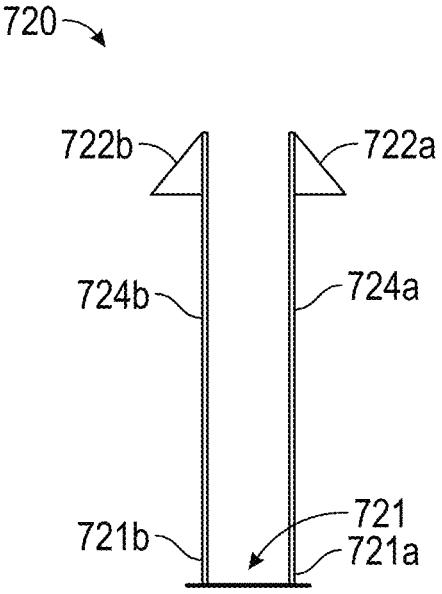
FIGS. 12A-12B show another exemplary embodiment of a mounting post.
Figure 12B:
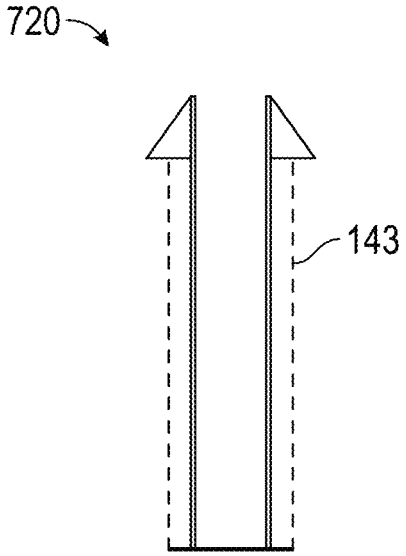

FIGS. 12A-12B illustrate another embodiment of a post 720 that can be used in conjunction with a housing (e.g., housings 110 and 210) and reel assembly (e.g., reel assembly 140) and including a retaining mechanism. The post 720 can include multiple members 724*a*, 724*b* having inner ends 721*a*, 721*b* coupled with the housing 110 and outer ends 722*a*, 722*b* that include outer hooks that can compliantly move. Aperture 143 of the reel assembly 140 can fit over the outer hooks. The outer hooks can retain the reel assembly 140 in place. The reel assembly 140 can be removed by squeezing together the hooks and lifting the reel 142 from the post 720.

Figure 13:
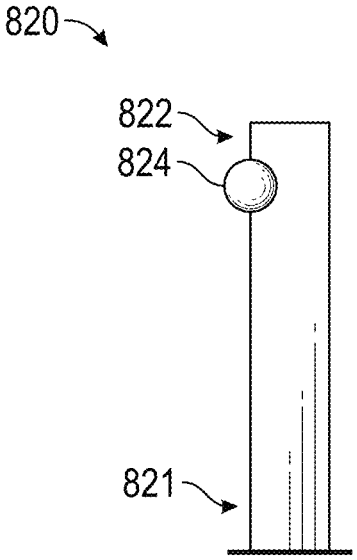
FIG. 13 shows another exemplary embodiment of a mounting post.

FIG. 13 shows a post 820. The post 820 can be used in a retaining mechanism such as the retaining mechanism 122. The post 820 is attached at an inner end 821 with the housing 110 and an outward end 822 extends therefrom. A post body extends therebetween. The post body can include a snap-fit connector 824 for engagement with a corresponding snap-fit recess not shown in the reel assembly 140 (e.g., within the aperture 143). The snap-fit connector 824 can include a ball. The ball can be mounted on a spring mechanism. The reel 142 can be pressed over the outer end 822 of the post 820 and snapped with a corresponding groove with the snap-fit connector 824. The snap-fit connection can act as a drag mechanism on the reel assembly 140.

Figure 14:
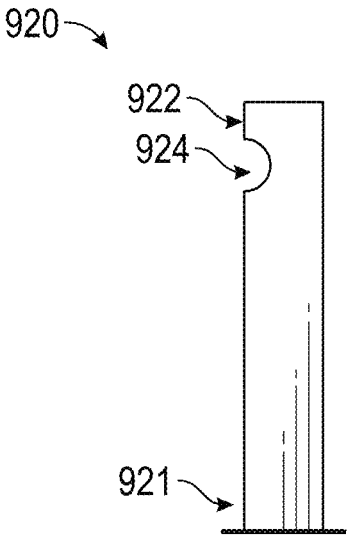
FIG. 14 shows another exemplary embodiment of a mounting post.

FIG. 14 shows a post 920. The post 920 can be used in a retaining mechanism such as the retaining mechanism 122. The post 920 is attached at an inner end 921 with the housing 110 and an outward end 922 extends therefrom. A post body extends therebetween. The post body can include a notch 924 for engagement with a corresponding snap-fit connector (not shown) in the reel assembly 140 (e.g., within the aperture 143). The reel 142 can be pressed over the outer end 922 of the post 920 and snapped with the corresponding snap-fit connector with the notch 924. The snap-fit connection can act as a drag mechanism on the reel assembly 140.

Figure 15:
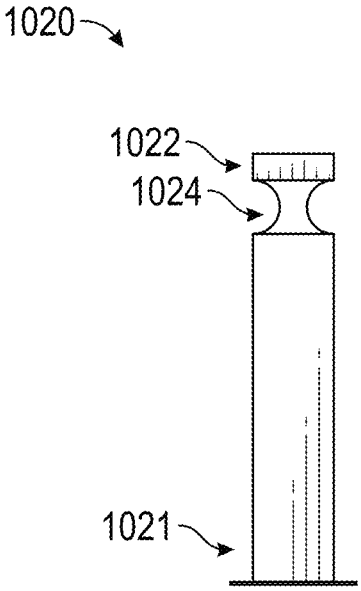
FIG. 15 shows another exemplary embodiment of a mounting post.

FIG. 15 shows a post 1020. The post 1020 can be used in a retaining mechanism such as the retaining mechanism 122. The post 1020 is attached at an inner end 1021 with the housing 110 and an outward end 1022 extends therefrom. A post body extends therebetween. The post body can include a groove 1024 for engagement with a corresponding snap-fit connector (not shown) in the reel assembly 140 (e.g., within the aperture 143). The snap-fit groove 1024 can be circumferential. The reel 142 can be pressed over the outer end 1022 of the post 1020 and snapped with the corresponding snap-fit connector with the snap-fit groove 1024. The snap-fit connection can act as a drag mechanism on the reel assembly 140.

Figure 16:
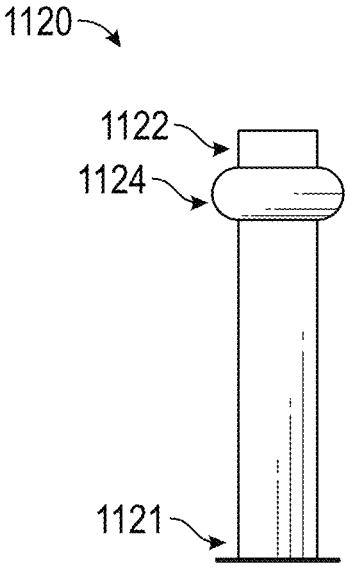
FIG. 16 shows another exemplary embodiment of a mounting post.

FIG. 16 shows a post 1120. The post 1120 can be used in a retaining mechanism such as the retaining mechanism 122. The post 1120 is attached at an inner end 1121 with the housing 110 and an outward end 1122 extends therefrom. A post body extends therebetween. The post body can include a snap-fit connector 1124 for engagement with a corresponding snap-fit recess not shown in the reel assembly 140 (e.g., within the aperture 143). The snap-fit connector 1124 can include a radially extending ridge. The ridge can be smooth and/or of a compliant material. The reel 142 can be pressed over the outer end 1122 of the post 1120 and snapped with a corresponding groove with the snap-fit connector 1124. The snap-fit connection can act as a drag mechanism on the reel assembly 140.

Figure 17:
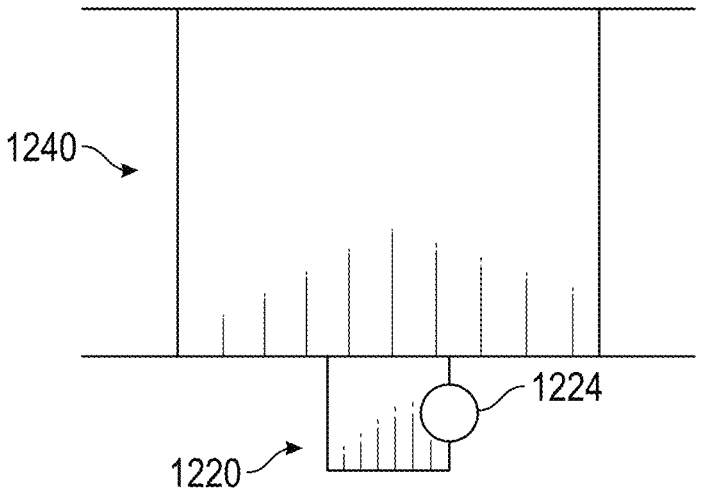
FIG. 17 shows another exemplary embodiment of a reel.

FIG. 17 illustrates another implementation of a reel assembly 140. A reel 1240 can include an integrated post member 1220. The integrated post member 1220 can extend from one end of the reel 1240. The integrated post member 1220 can optionally include a snap-fit connector 1224. The housing 110 can include a corresponding snap-fit groove. The reel 1240 can rotate within the housing 110 about the integrated post member 1220.

Figure 18:
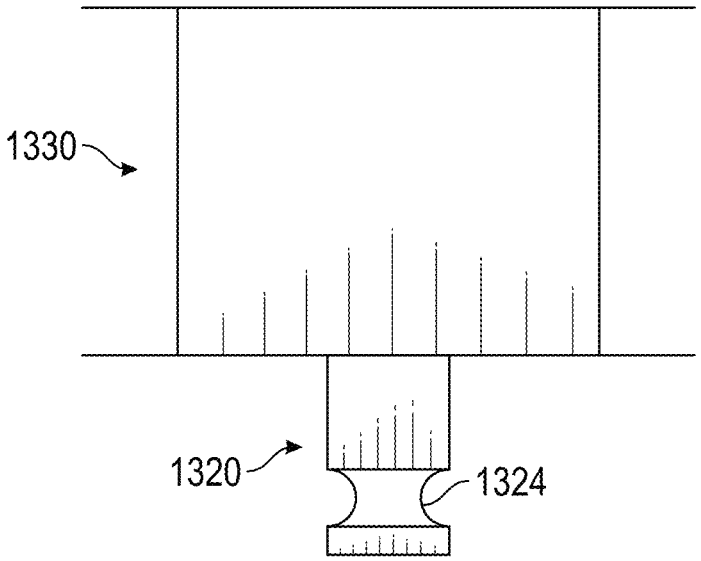
FIG. 18 shows another exemplary embodiment of a reel.

FIG. 18 illustrates another implementation of a reel assembly 140. A reel 1340 can include an integrated post member 1320. The integrated post member 1320 can extend from one end of the reel 1340. The integrated post member 1320 can optionally include a snap-fit groove 1324. The housing 110 can include a corresponding snap-fit projection. The reel 1340 can rotate within the housing 110 about the integrated post member 1320.

Figure 19A:
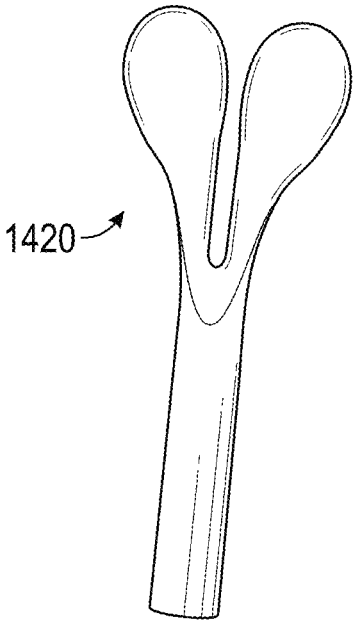
FIGS. 19A-B show another exemplary embodiment of a mounting mechanism.
Figure 19B:
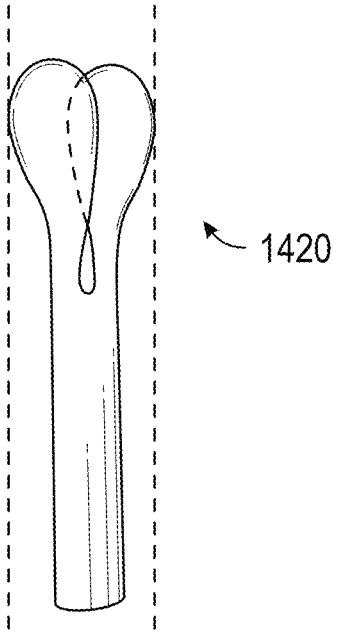

FIGS. 19A-B illustrate another implementation of a mounting assembly 1420. Similar to the mounting assembly 120, the mounting assembly 1420 can include a post having a fork end. Two forked portions on the forked end can be biased radially outwardly. The forked end can be heart shaped. The mounting assembly 1420 can be adapted to receive the reel assembly 140 and similar reel assemblies described above.

Figure 20:
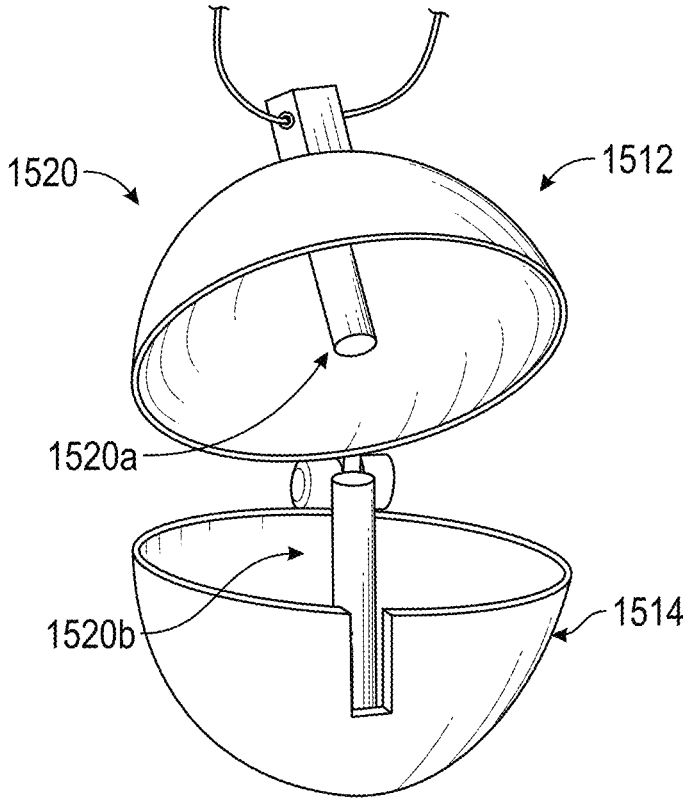
FIG. 20 shows another exemplary embodiment of a mounting mechanism.

FIG. 20 illustrates another implementation of a mounting assembly 1520. The mounting assembly 1520 can include a post having a first portion 1520*a* coupled with a first housing portion 1512 and a second portion 1250*b* coupled with a second housing portion 1514. The two post portions 1520*a*, 1520*b* can be aligned when the housing portions 1512, 1514 are in a closed housing configuration. The two post portions 1520*a*, 1520*b* can be adapted to align with the aperture 143 of the reel assembly 140. Each of the two post portions 1520*a*, 1520*b* can be at least partially received within the aperture 143 to retain the reel assembly 140.

Figure 21A:
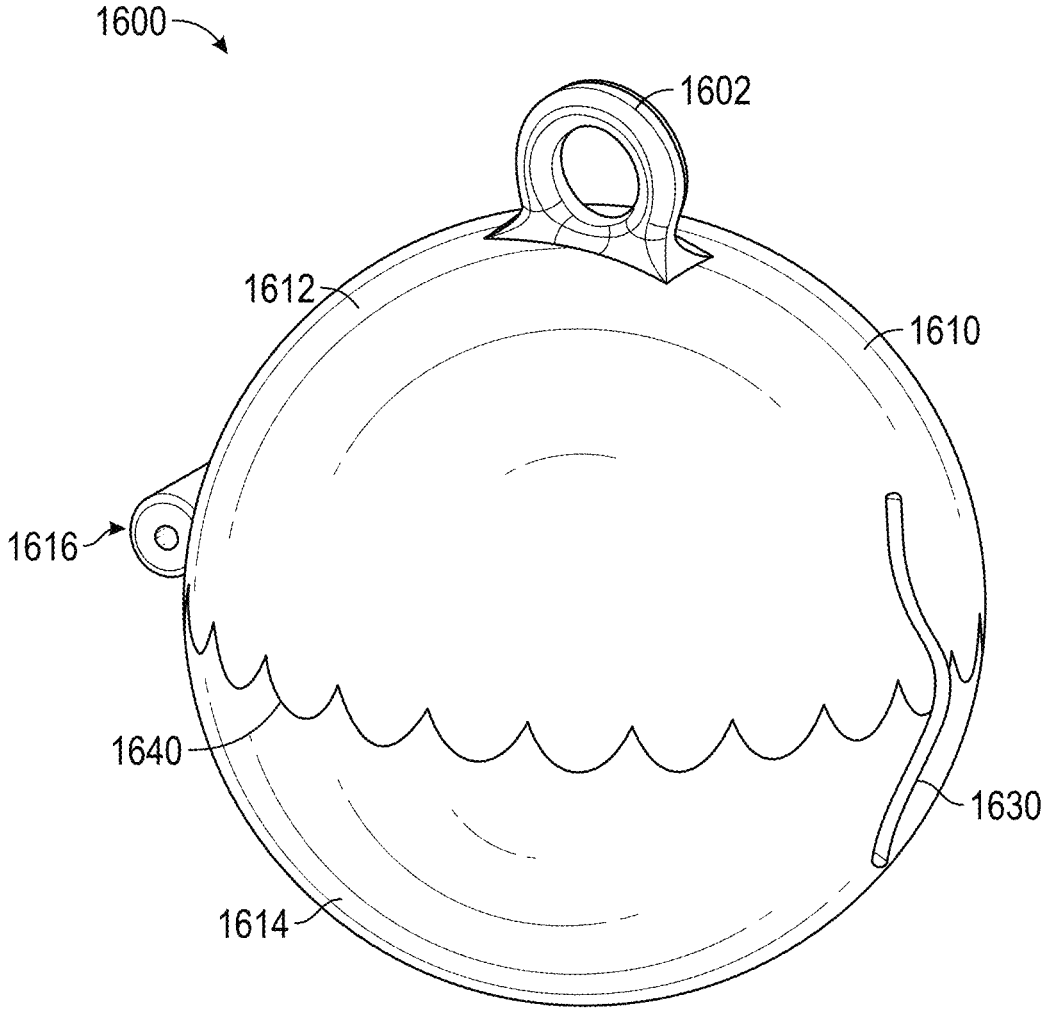
FIG. 21A shows another embodiment of an article of jewelry in a closed configuration.
Figure 21B:
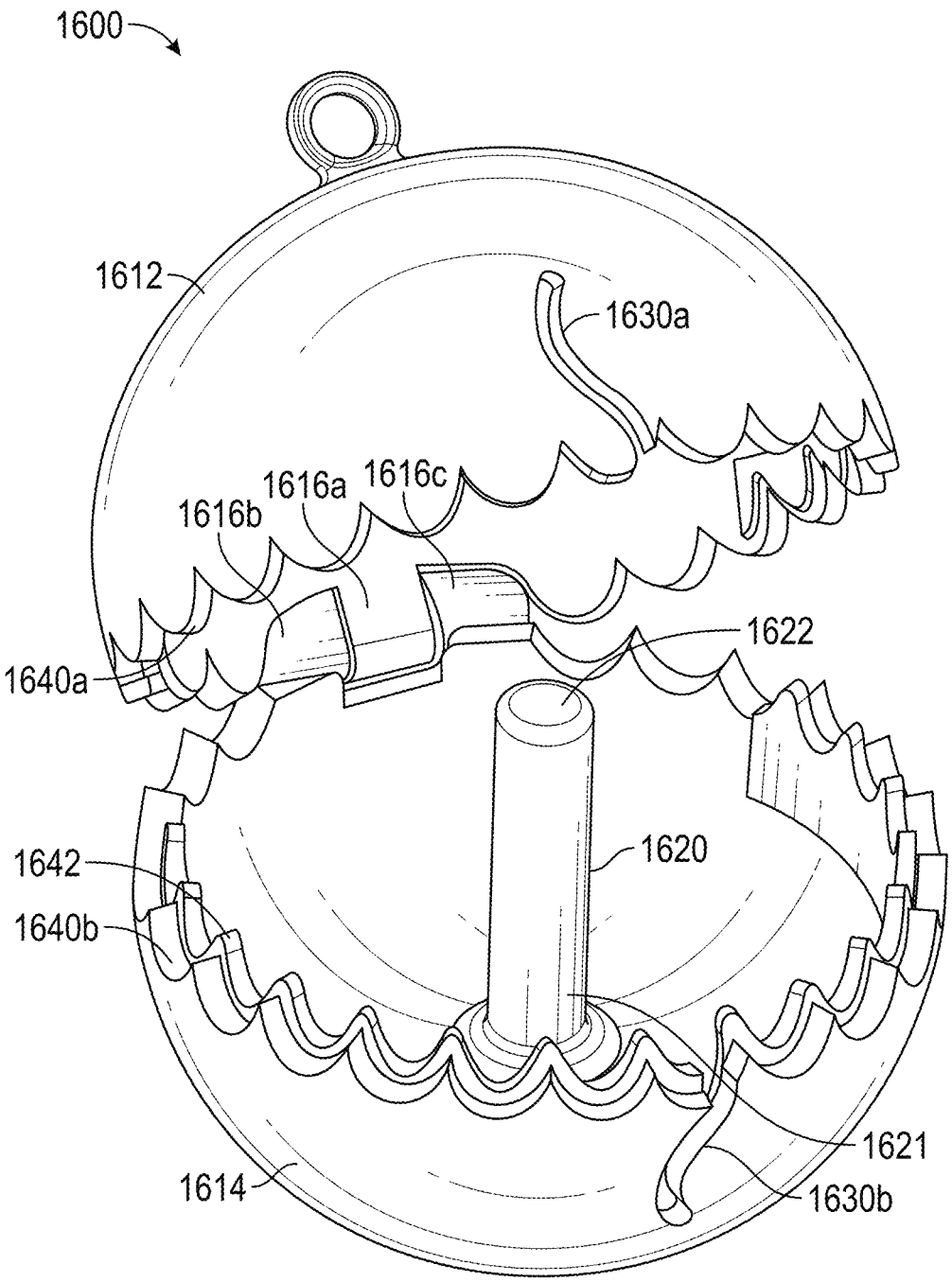
FIG. 21B shows the article of jewelry in an open configuration.
Figure 22:
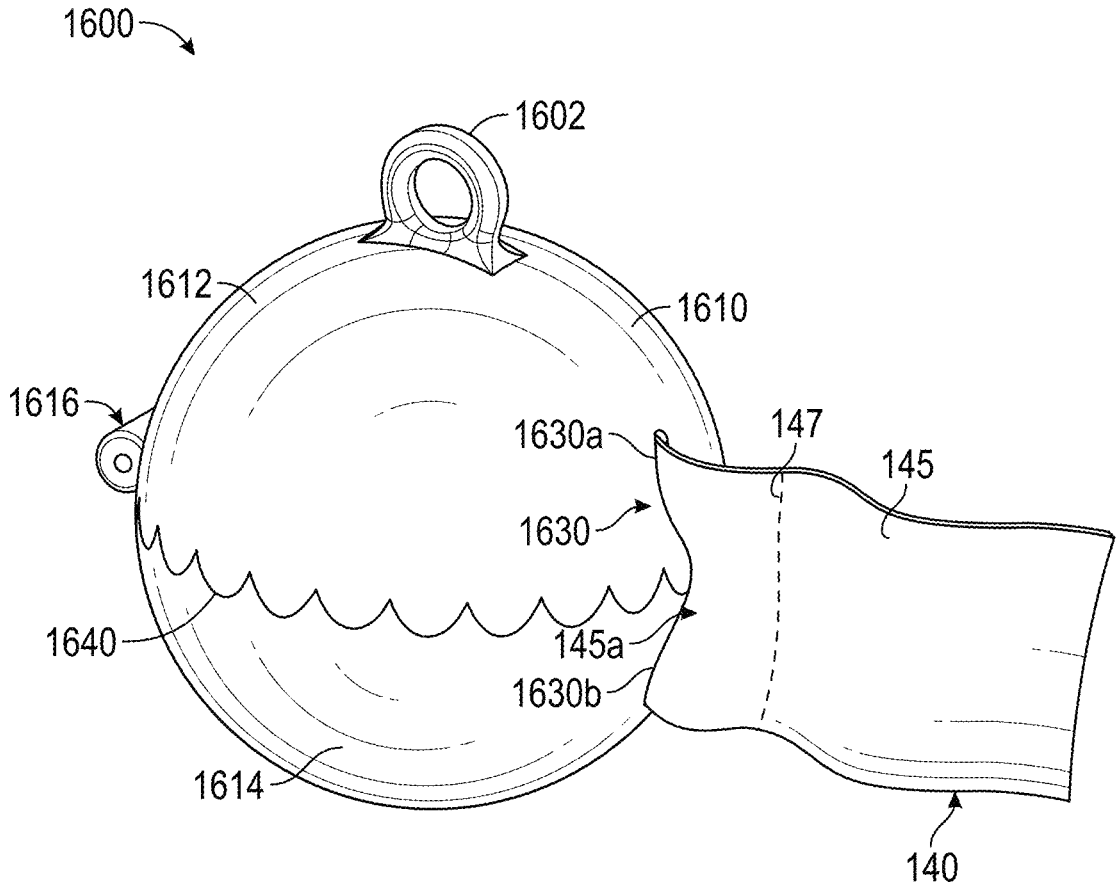
FIG. 22 shows the article of jewelry in the closed configuration loaded with a paper roll assembly.

FIGS. 21A-22 show another embodiment of an article of jewelry 1600. The article 1600 can include any of the features described above in relation to FIGS. 1-20. The article 1600 can include an outer housing 1610. The shape of the outer housing 1610 can depend on the type of jewelry of the article 1600. The outer housing 1610 can be generally spherical. Alternatively, the shape of the outer housing 1610 can comprise any of various desirable form factors such as those described above.

Depending of the type of jewelry, the outer housing 1610 can include an attachment point 1602, such as a hook or loop. The attachment point 1602 can be coupled with any of other various accessories or articles of jewelry such as the not including necklaces, bracelets and earring mounts. The attachment point 1602 can be formed integrally with the housing 1610 or attached thereto via a mechanical attachment mechanism, adhesive, or other attachment mechanism.

The outer housing 1610 can comprise a first portion 1612, which can be an upper portion, and a second portion 1614, which can be a lower portion. The first portion 1612 and/or the second portion 1614 can be shaped as hemispheres. Alternatively, the first portion 1612 and/or the second portion 1614 can be shaped differently. Together, the first and second portions 1612, 1614 can bound a generally enclosed space.

The outer housing 1610 can include a hinge 1616. The first portion 1612 can comprise a hinge component 1616*a*. The second portion 1614 can comprise one or more hinge components 1616*b*, 1616*c*. The hinge components 1616A-C can comprise an aperture extending therethrough for receiving a pin. The pin member can extend through the hinge 1616 and allow rotation of the first portion 1612 relative to the second component 1614.

The first portion 1612 can be movable with respect to the second portion 1614 about the hinge 1616. Movement of the first portion 1612 relative to the second portion 1614 can transition the housing 1610 between an open configuration shown in FIG. 21B and a closed configuration shown in FIG. 21A. In certain implementations, the first portion 1612 can be fully opened relative to the second portion 1614. In certain implementations, the rotation of the first portion 1612 can be limited by one or more interference portions on the outer housing 1610 and/or one or more of the hinge components 1616*a*-*c*.

The first portion 1612 can interface with the second portion 1614 at an interface 1640. The interface 1640 can extend around a circumference of the outer housing 1610. The interface 1640 can comprise an upper edge 1640*a* on the first portion 1612. The upper edge 1640*a* can extend around, fully or partially, a circumference of the first portion 1612. The second portion 1614 can comprise a lower edge 1640*a*. The lower edge 1640*a* can extend around, fully or partially, a circumference of the second portion 1614. The upper edge 1640*a* can contact the lower edge 1640*b* at one or more points around the circumference of the outer housing 1610. In certain implementations contact between the upper and lower edges 1640*a*, 1640*b* can be substantially continuous around the circumference of the outer housing 1610. Desirably the interface 1640 can seal closed an interior portion of the outer housing 1610.

The interface 1640 (e.g., the upper and lower edges 1640*a*,1640*b*) can have various shape factors. The interface 1640 can include a scalloped shaped edge comprising a plurality of projections and corresponding grooves on either the upper or lower edges 1640*a*,1640*b*. Alternatively, the interface 1640 can comprise a straight edge, an irregular edge, or otherwise shaped edge between the first and second portions 1612, 1614. In certain implementations, the interface 1640 can be decorative and/or prevent unwanted movement between the first and second portions 1612, 1614 in the closed configuration.

The lower edge 1640*b* can include an inner lip 1642. The inner lip 1642 can be located radially inward of the lower edge 1640*b* (e.g., recessed). The inner lip 1642 can be offset a height above the lower edge 1640*b*. The inner lip 1642 can extend around the circumference of the interface 1640. The inner lip 1642 can prevent unwanted movement between the first and second portions 1612, 1614 in the closed configuration.

The outer housing 1610 can include a post 1620. The post 1620 can include a base 1621 and an outer end 1622. The base 1621 can be a proximal end and the outer end 1622 can be a distal end. The base 1621 can be coupled with an interior surface of the second portion 1614 of the outer housing 1610. Alternatively, the post 1620 can be coupled with another portion of the outer housing 1610 (e.g., the first portion 1612). The post 1620 can extend generally perpendicularly into the interior space of the outer housing 1610 (i.e. with respect to the interior surface of the second portion 1614). The base portion 1621 of the post 1620 can be generally cylindrical in shape. The base portion 1621 can have a greater diameter than the outer end 1622. The outer end 1622 can be cylindrical in shape. Alternatively, the post 1620 can have any of the shapes described above in relation to FIGS. 1-20.

The post 1620 can function as a mounting location for the reel assembly 140 with a roll 144, as described above. The open configuration of the outer housing 1610 can allow for installation of the reel assembly 140 on the post 1620. The reel assembly 140 can be enclosed within the interior space of the interface 1640 in the closed configuration of the outer housing 1610.

The outer housing 1610 can include a nonlinear slot 1630. The nonlinear slot 1630 can extend through the outer housing 1610 into the interior space therein. The nonlinear slot 1630 can include one or more curves or angled segments between first and second ends thereof. The nonlinear slot 1630 can be divided into one or more segments. A first segment 1630*a* can be located on the first portion 1612. A second segment 1630*b* can be located on the second portion 1614. The first and second segments 1630*a*, 1630*b* can be aligned to form a single, continuous slot 1630. The nonlinear slot 1630 can extend across the interface 1640. The nonlinear slot 1630 can extend through the inner lip 1642. The nonlinear slot 1630 can be aligned with the post 1620 (e.g., a major dimension of the nonlinear slot 1630 can be parallel with a longitudinal axis of the post 1620).

The nonlinear slot 1630 can be sized to allow passage of paper therethrough. The nonlinear slot 1630 can also impede the passage of paper therethrough (e.g., by frictional engagement with the paper) to apply a tension to the tail section 145 (e.g., during tearing). As illustrated in FIG. 22, the tail section 145 of the roll 144 can be extended through the nonlinear slot 1630. The tail section 145 can include the perforation line 147. The one or more curves or angled segments of the nonlinear slot 1630 can create one or more corresponding bends 145*a* in the tail section 145. The bends 145*a* can cause the paper of the tail section 145 to frictionally engage with inner faces of the nonlinear slot 1630. The nonlinear slot 1630 can make it more difficult to draw the tail section 145 through the nonlinear slot 1630. The one or more curves or angled segments can allow the tail section 145 to stay more securely within the nonlinear slot 1630 (e.g., compared with a straight slot). Thus, after a section of the roll 144 has been torn off the tail section 145, the nonliner slot 1630 can securely retain the shortened portion (outside the housing 1610) that provides a grip point for a user to withdraw additional paper of the roll 145 (e.g., having messages printed thereon). In use, a user can draw the tail section 145 out of the article 1600 through the nonlinear slot 1630 against the friction created by the nonlinear slot 1630 and the bends 145*a*. After having withdrawn a section of the tail section 145, the tail section 145 can then be removed from the rest of the roll 144, such as by tearing along the perforation line 147. The nonlinear slot 1630 can include tapered edge on an inner side of the housing 1610. The tapered edges can facilitate feeding the tail section 145 into the nonlinear slot 1630. In one implementation, the tail section 145 can be placed in one of the first or second section 1630*a*, 1630*b* with the housing 1610 in the open configuration. This can facilitate loading the tail section 145 into the nonlinear slot 1630. When the housing 1610 is closed, the other side of the tail section 145 can be slipped into the other one of the first or second sections 1630*a*, 1630*b*.

Figure 23D:
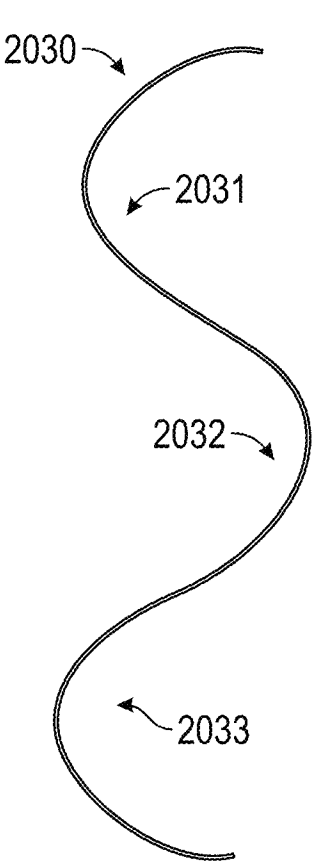
FIGS. 23A-D show various embodiments of a nonlinear paper slot for the article of jewelry.
Figure 23C:
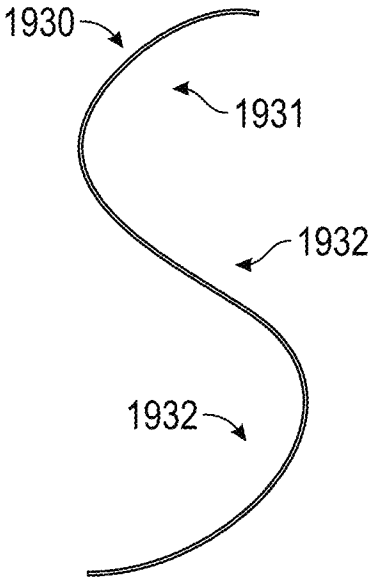
Figure 23B:
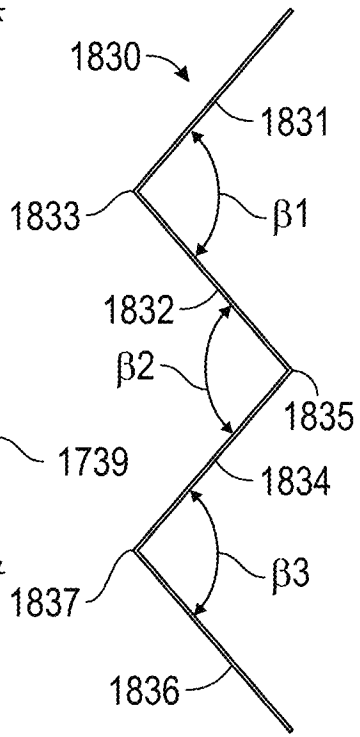
Figure 23A:
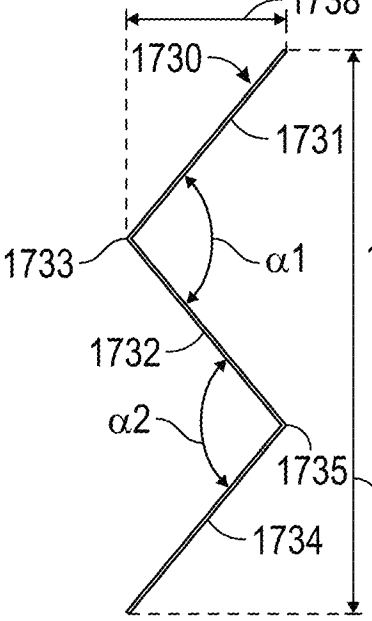

FIGS. 23A-D show alternative implementations of nonlinear slot. FIG. 23A shows a nonlinear slot 1730. The nonlinear slot 1730 can include a plurality of linear segments connected together at one or more angles. The nonlinear slot 1730 can be generally "S" shaped. The nonlinear slot 1730 can include first straight segment 1731 and a second straight segment 1732 connected by an intersection 1733. An angle α1 between the first straight segment 1731 and the second straight segment 1732 can be between 90° and 180°, although this is not required. The nonlinear slot 1730 can include a third straight segment 1734 and the second straight segment 1732 connected by an intersection 1735. An angle α2 between the third straight segment 1734 and the second straight segment 1732 can be between 90° and 180°, although this is not required.

The nonlinear slot 1730 can have a slot width. The slot width can extend from a first end to a second end of the nonlinear slot 1730. The slot width can be substantially uniform. Alternatively, the slot width can be tapered at one or more points along a length thereof. The slot width can be in the ranges given above for the slot 130. The nonlinear slot 1730 can have a width 1738 and a height 1739. The width 1738 and the height 1739 can form an aspect ratio (height/width). In certain implementations, the aspect ratio for the nonlinear slot 1730 (or any other nonlinear slot described herein) can be between 250:1 and 1:1. In certain implementations, the aspect ratio for the nonlinear slot 1730 (or any other nonlinear slot described herein) can be between 100:1 and 4:1. In certain implementations, the aspect ratio for the nonlinear slot 1730 (or any other nonlinear slot described herein) can be between 20:1 and 5:1. In certain implementations, the aspect ratio for the nonlinear slot 1730 (or any other nonlinear slot described herein) can be between 8:1 and 4:1. In certain implementations, the aspect ratio for the nonlinear slot 1730 (or any other nonlinear slot described herein) can be approximately 7:1 or 6:1.

FIG. 23B shows a nonlinear slot 1830. The nonlinear slot 1830 can include a plurality of linear segments connected together at one or more angles. The nonlinear slot 1830 can be generally "W" shaped. The nonlinear slot 1830 can include a first straight segment 1831 and a second straight segment 1832 connected by an intersection 1833. An angle θ1 between the first straight segment 1831 and the second straight segment 1832 can be between 90° and 180°, although this is not required. The nonlinear slot 1830 can include a third straight segment 1834 and the second straight segment 1832 connected by an intersection 1835. An angle (32 between the third straight segment 1834 and the second straight segment 1832 can be between 90° and 180°, although this is not required. The nonlinear slot 1830 can include the third straight segment 1834 and a fourth straight segment 1836 connected by an intersection 1837. An angle (33 between the third straight segment 1834 and the fourth straight segment 1836 can be between 90° and 180°, although this is not required.

FIG. 23C shows a nonlinear slot 1930. The nonlinear slot 1930 can comprise a plurality of curved regions. The nonlinear slot 1930 can be generally "S" shaped. The nonlinear slot 1930 can include a first curved portion 1931 and a second curved portion 1932.

FIG. 23D shows a nonlinear slot 2030. The nonlinear slot 2030 can comprise a plurality of curved regions. The nonlinear slot 2030 can be generally "W" shaped. The nonlinear slot 2030 can include a first curved portion 2031, a second curved portion 2032, and a third curved portion 2033.

Figure 24:
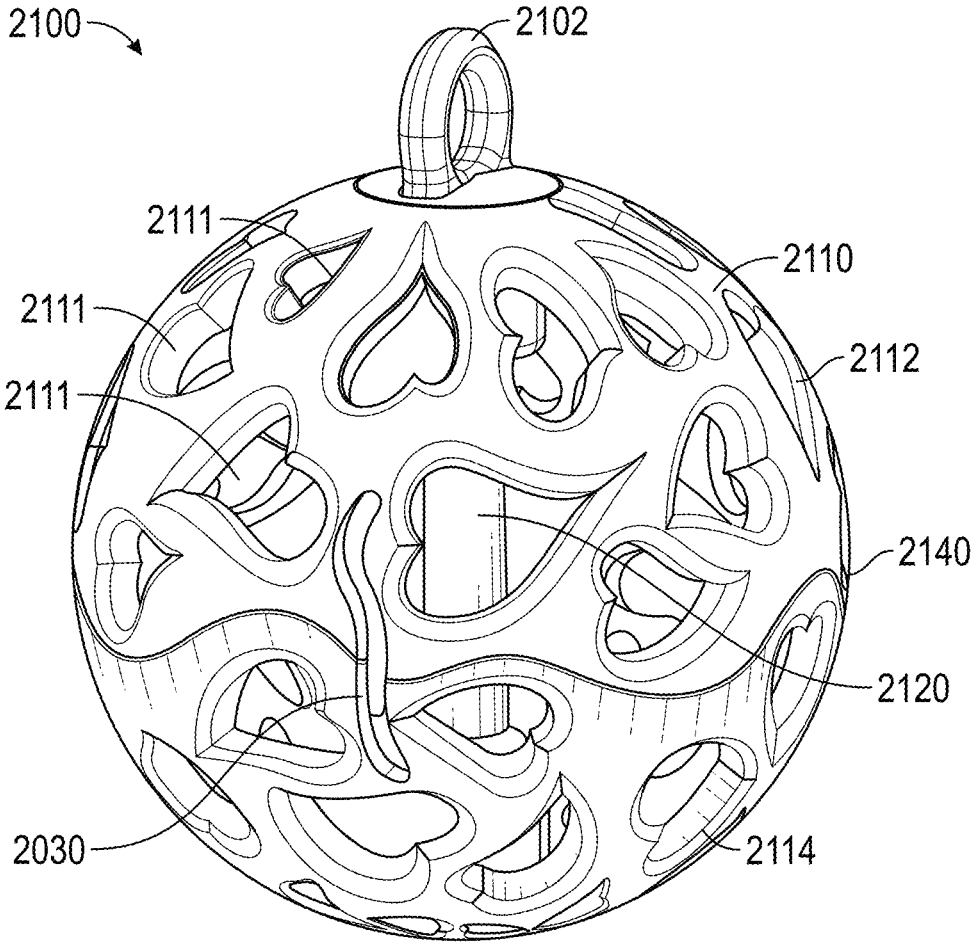
FIG. 24 shows another embodiment of an article of jewelry.
Figure 25A:
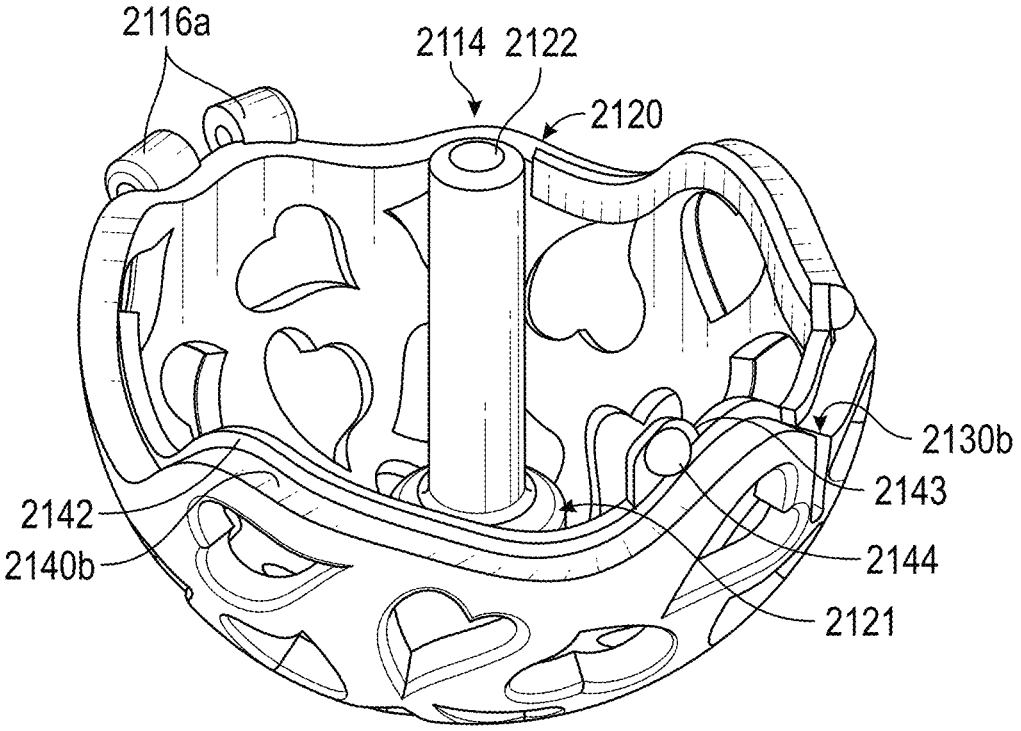
FIG. 25A shows a lower portion of the article of jewelry.
Figure 25B:
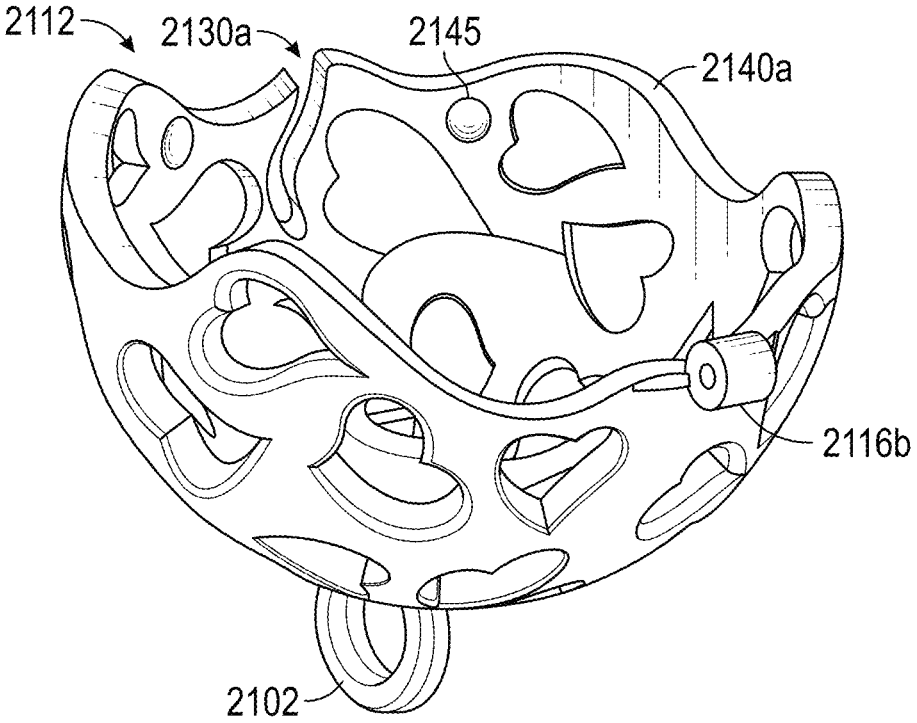
FIG. 25B shows an upper portion of the article of jewelry.
Figure 26:
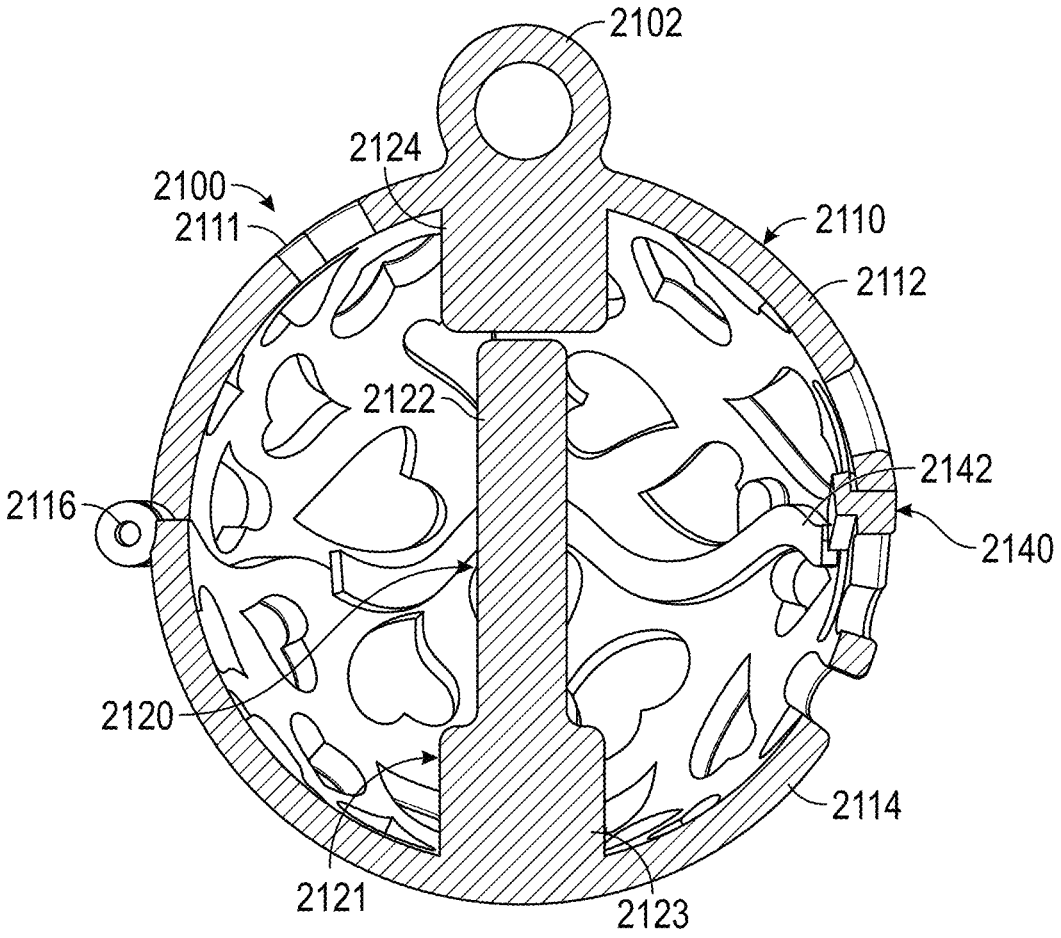
FIG. 26 shows a section view of the article of jewelry.

FIGS. 24-26 illustrate another embodiment of an article of jewelry 2100. The article 2100 can include a housing having an outer surface 2110. The outer surface 2110 can comprise an attachment point 2102. The outer surface 2110 can be formed of a first portion 2112 and a second portion 2114. The first portion 2112 can be an upper portion and the second portion 2114 can be a lower portion. The first and second portions 2112, 2114 can be generally hemispherically shaped. The first and second portions 2112, 2114 can be hingedly coupled together at a hinge 2116. The hinge 2116 can include flanges 2116*a*, 2116*b* with a pin therethrough. The first portion 2112 can interface with the second portion 2114 at an interface 2140. The interface 2140 can include an upper edge 2140*a* and a lower edge 2140*b*. The edges 2140*a*, 2140*b* can extend around the circumference of the outer surface 2110. The interface 2140 can include an inner lip 2142. The inner lip 2142 can be located on either the first portion 2112 or the second portion 2114. The inner lip 2142 can extend around a portion of the circumference or the entire circumference of the outer surface 2110. The outer surface 2110 can comprise a plurality of through holes 2111 to allow viewing of the contents of the article 2100.

The outer housing 2110 can comprise a clasp mechanism for coupling together the first and second portions 2112, 2114 in a closed configuration, as shown in FIG. 24. The clasp mechanism can comprise an extension 2143. The extension 2143 can extend from the inner lip 2142. The extension 2143 can extend in a circumferential direction from the lower edge 2140*b*. The extension 2143 can comprise a compliant material such as metal or plastic. Alternatively, the projection 2144 can extend directly from the lower edge 2140*b*. The extension 2143 can include a ball or ridge 2144. The ridge 2144 can extend from the extension 2143 in a radial direction. The ridge 2144 can extend over the lower edge 2140*b*.

The clasp mechanism can comprise a groove 2145. The groove 2145 can be on an inner surface of the first portion 2112. The groove 2145 can be aligned with the ridge 2143. The groove 2145 can be sized such that the ridge 2144 can engage therein for creating a snap fit connection between the first portion 2112 and the second portion 2114. Optionally there are a plurality of clasp mechanisms located at intervals around the circumference of the interface 2040. Alternatively, the placement of the extension 2143 and ridge 2144 on the second portions 2114 and the groove 2145 on the first portion 2112 can be reversed. Alternatively, the placement of the ridge 2144 and groove 2145 can be reversed.

The article 2100 can include a post 2120. The post 2120 can be generally cylindrically shaped. The post 2120 can be coupled with an inner surface of the second portion 2114. Alternatively, the post 2120 can be coupled with an inner surface of the first portion 2112. The post 2120 can include a base 2121 and an outer end 2122. The base 2121 can be mounted on a lower base portion 2123. The lower base portion 2123 can have a diameter greater than a diameter of the outer end 2122. The first portion 2112 can include an upper extension portion 2124. The upper extension portion 2124 can be aligned with the post 2120. The outer end 2122 can contact with the extension portion 2124 in the closed configuration of the article 2100. The extension portion 2124 can have a diameter greater than the diameter of the outer end 2122. The extension portion 2124 can thereby secure the reel assembly 140 when mounted on the post 2120 in the closed configuration. Alternatively, the post 2120 can include any of the features for the posts shown in FIGS. 1-20.

The article 2100 can include a nonlinear slot 2130. The nonlinear slot 2130 can comprise a plurality of curved and/or straight segments. The nonlinear slot 2130 can include a first segment 2130*a* and a second segment 2130*b*. The nonlinear slot 2130 can be aligned with the post 2120.

CLAUSES

1. An article of jewelry, comprising:

a housing, the housing having a first portion and a second portion, the first and second portions hingedly coupled together to form an interior enclosed space, the first and second portions closable by a clasp; and a post disposed within the interior enclosed space, a first end of the post coupled with one of the first and second portions of the housing and a second end of the post extending into the interior enclosed space;

wherein the post comprises a retaining mechanism configured for removably snap-fitting a reel assembly with the post; and wherein the housing further includes a slot extending through at least one wall of the housing and configured to receive a tail section of a paper roll therethrough.

2. The article of Clause 1, wherein the reel assembly comprises a reel member and the paper roll, the paper roll wrapped around a body of the reel member, and the reel member having a central aperture.

3. The article of Clause 2, wherein the post is configured to snap within the central aperture of the reel member of the reel assembly, the retaining mechanism exerting a radially outward force from the post to an inner surface of the central aperture of the reel, the radially outward force exerting drag on the reel assembly to prevent free rolling of the reel with respect to the post.

4. The article of Clause 1, wherein the paper roll comprises a plurality of sheets separated by perforated lines.

5. The article of Clause 1, wherein the article of jewelry is one of a pendant, a bracelet, or an earring.

6. The article of Clause 1, wherein the slot is at least partially disposed in both the first portion and the second portion of the housing.

7. The article of Clause 1, wherein the retaining mechanism comprises a forked portion at the second end of the post and includes first and second forks that are biased radially outward.

8. The article of Clause 1, wherein the post is formed integrally with the first portion.

9. The article of Clause 1, wherein the retaining mechanism comprises one or more outwardly extending compliant members coupled with the post.

10. The article of Clause 1, wherein the retaining mechanism comprises a looped wire structure configured to exert a radially outward force from the post to the reel assembly.

11. The article of Clause 1, wherein the retaining mechanism comprises a snap-fit ball or ridge coupled with the post configured to snap-fit with a corresponding groove of the reel assembly.

12. The article of Clause 1, wherein the retaining mechanism comprises one or more grooves or notches on the post configured to snap-fit with a corresponding groove of the reel assembly.

13. The article of Clause 1, wherein the retaining mechanism comprises one or more cantilevered hook for retaining the reel assembly.

14. An article of jewelry, comprising:

a housing, the housing having a first portion and a second portion, the first and second portions hingedly coupled together to form an interior enclosed space, wherein the housing further includes a slot extending through at least one wall of the housing;

a post disposed within the interior enclosed space, a first end of the post coupled with one of the first and second portions of the housing and a second end of the post extending into the interior enclosed space;

a reel assembly comprising a reel member and a paper roll, the paper roll wrapped around a body of the reel member, the reel member having a central aperture;

a retaining mechanism for snap-fitting the reel assembly with the post;

wherein the reel assembly is removably mounted in the housing with the central aperture of the body of the reel member disposed over the post, the retaining mechanism exerting a radially outward force from the post to provide a snap-fit connection between the reel member and the post, the radially outward force exerting drag on the reel assembly to prevent free rolling of the reel member with respect to the post; and wherein a tail section of the paper roll extends out of the housing through the slot such that a user can retrieve the tail section of the paper roll without opening the housing.

15. The article of Clause 14, wherein the paper roll comprises a plurality of sheets separated by perforated lines.

16. The article of Clause 14, wherein the article of jewelry is one of a pendant, a bracelet, or an earring.

17. The article of Clause 14, wherein the slot is at least partially disposed in both the first portion and the second portion of the housing.

18. The article of Clause 14, wherein the retaining mechanism comprises a forked portion at the second end of the post and includes first and second forks that are biased radially outward to engage an interior surface of the central aperture of the reel member.

19. The article of Clause 14, wherein the post is formed integrally with the first portion.

20. The article of Clause 14, wherein the retaining mechanism comprises one or more outwardly extending resilient members coupled with the post for engaging with the interior surface of the central aperture of the reel member.

21. The article of Clause 14, wherein the retaining mechanism comprises a looped wire structure configured to exert the radially outward force.

22. The article of Clause 14, wherein the retaining mechanism comprises a snap-fit ball or ridge coupled with the post and an interior surface of the central aperture of the reel member comprises one or more grooves or notches for engaging with the snap-fit ball.

23. The article of Clause 14, wherein the retaining mechanism comprises one or more grooves or notches on the post and an interior surface of the central aperture of the reel member comprises a snap-fit ball or ridge for engaging with the one or more grooves or notches.

24. The article of Clause 14, wherein the retaining mechanism comprises one or more cantilevered hooks for retaining the reel assembly.

Certain Terminology

Terms of orientation used herein, such as "top," "bottom," "proximal," "distal," "longitudinal," "lateral," and "end," are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Several illustrative embodiments of an article of jewelry have been disclosed. Although this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular embodiment of the inventions disclosed herein. No aspects of this disclosure are essential or indispensable. In many embodiments, the devices, systems, and methods may be configured differently than illustrated in the figures or description herein. For example, various functionalities provided by the illustrated modules can be combined, rearranged, added, or deleted. In some embodiments, additional or different processors or modules may perform some or all of the functionalities described with reference to the example embodiment described and illustrated in the figures. Many implementation variations are possible. Any of the features, structures, steps, or processes disclosed in this specification can be included in any embodiment.

In summary, various embodiments and examples of articles of jewelry and related methods have been disclosed. This disclosure extends beyond the specifically disclosed embodiments and examples to other alternative embodiments and/or other uses of the embodiments, as well as to certain modifications and equivalents thereof. Moreover, this disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims.

What is claimed is:

1. An article of jewelry, comprising:

a housing having a first portion and a second portion forming an outer wall, the first portion movable with respect to the second portion about a hinge between a closed configuration and an open configuration, the hinge comprising a pin;

a post having a first end coupled with the second portion of the housing and a second end extending towards and contacting the first portion of the housing with the housing in the closed configuration, the post configured to removably receive a reel thereon, the reel comprising a paper roll, the paper roll containing a plurality of printed messages thereon, each message separated by a perforation line across the paper roll; and a nonlinear paper slot extending through the outer wall of the housing, the nonlinear paper slot configured to apply at least one bend to a section of the paper roll received therethrough, the nonlinear paper slot disposed in a rigid portion of the housing that maintains a shape of the nonlinear paper slot in the open configuration and the closed configuration;

wherein the article of jewelry further comprises an attachment loop;

wherein, in the open configuration, the second end of the post is uncovered by opening of the first portion of the housing such that the reel can be mounted on the post;

wherein the housing includes an interface between the first portion of the housing and the second portion of the housing, the interface including a recessed inner lip having an irregular edge;

wherein the housing includes a clasp for maintaining the housing in the closed configuration, the clasp configured to snap-fit within a corresponding groove in the closed configuration;

wherein the nonlinear paper slot comprises one or more curved portions in an s-shape;

wherein a segment of the paper roll extends within the nonlinear paper slot with the reel disposed on the post and the housing in the closed configuration such that one of the plurality of printed messages can be separated from the paper roll along the perforation line outside the housing;

wherein a first segment of the nonlinear paper slot extends through the first portion of the housing and a second segment of the nonlinear paper slot extends through the second portion of the housing, the first segment and the second segment divided between the respective first and second housing portions and aligned at an interface between the first portion of the housing and the second portion of the housing;

wherein, the post extends through a plane dividing the first portion of the housing and the second portion of the housing at the interface;

wherein the post is disposed within a spherical interior space of the housing; and wherein the at least one bend increases frictional engagement between first and second faces of the segment of the paper roll and inner faces of the nonlinear paper slot, the inner faces of the nonlinear paper slot maintaining contact with the section of the paper roll received therethrough.

2. The article of claim 1, wherein the nonlinear paper slot is configured to apply a plurality of bends to the section of the paper roll.

3. The article of claim 1, wherein the increased frictional engagement between the section of the paper roll within the nonlinear paper slot and the inner faces of the nonlinear paper slot prevents free rolling of the reel with respect to the post as the paper roll is withdrawn from the housing through the nonlinear paper slot.

4. The article of claim 1, wherein the interface comprises a scalloped edge.

5. The article of claim 1, wherein the interface comprises an irregular edge.

6. The article of claim 1, wherein the interface comprises a straight edge.

7. The article of claim 1, wherein the post comprises a retaining mechanism configured to retain the reel thereon.

8. The article of claim 1, wherein the post is configured to prevent free rolling of the reel with respect to the post with the reel installed thereon.

9. The article of claim 1, wherein the post is at least partially located within a first volume defined within the first portion of the housing and within a second volume defined within the second portion of the housing.

10. The article of claim 1, wherein the second end of the post contacts the second portion of the housing in the closed configuration.

11. The article of claim 1, wherein the article of jewelry comprises a pendant.

* * * * *